US006793613B2

(12) United States Patent
DeSmedt et al.

(10) Patent No.: US 6,793,613 B2
(45) Date of Patent: Sep. 21, 2004

(54) BAG BLOCKS

(75) Inventors: Eric DeSmedt, Green Bay, WI (US); Eric Loppnow, Green Bay, WI (US)

(73) Assignee: Hudson-Sharp Machine Co., Green Bay, WI (US)

( * ) Notice: Subject to any disclaimer, the term of this patent is extended or adjusted under 35 U.S.C. 154(b) by 69 days.

(21) Appl. No.: 10/077,580

(22) Filed: Feb. 15, 2002

(65) Prior Publication Data

US 2002/0134702 A1 Sep. 26, 2002

Related U.S. Application Data

(63) Continuation-in-part of application No. 09/785,795, filed on Feb. 16, 2001, now Pat. No. 6,601,707.

(60) Provisional application No. 60/300,958, filed on Jun. 26, 2001, and provisional application No. 60/300,047, filed on Jun. 21, 2001.

(51) Int. Cl.[7] ..... B31B 1/20

(52) U.S. Cl. ..... 493/194; 53/468; 493/229; 493/237

(58) Field of Search ..... 53/568, 570, 468; 206/554; 383/9; 493/194, 204, 227, 229, 226, 232, 237, 926

(56) References Cited

U.S. PATENT DOCUMENTS

| | | | | |
|---|---|---|---|---|
| 2,983,087 A | * | 5/1961 | Schofield | 383/9 |
| 3,126,094 A | | 3/1964 | Arnold et al. | |
| 3,966,524 A | * | 6/1976 | Lehmacher | 493/204 |
| 4,342,564 A | | 8/1982 | Lehmacher | |
| 4,557,384 A | * | 12/1985 | Membrino | 206/554 |
| 4,699,607 A | | 10/1987 | Lambrecht | |
| 4,811,417 A | | 3/1989 | Prince et al. | |
| 4,811,418 A | * | 3/1989 | Reifenhauser | 206/554 |
| 4,903,839 A | | 2/1990 | Mattiebe et al. | |
| 5,030,191 A | | 7/1991 | Reifenhauser | |
| 5,062,716 A | * | 11/1991 | Conrad et al. | 383/9 |
| 5,495,946 A | | 3/1996 | Pickering et al. | |
| 5,590,784 A | * | 1/1997 | Daniels | 206/554 |
| 5,931,581 A | * | 8/1999 | Garberg et al. | 383/9 |

FOREIGN PATENT DOCUMENTS

| | | |
|---|---|---|
| AU | 200022280 A1 | 9/2000 |
| EP | 0 967 155 A1 | 6/1999 |
| EP | 1 036 741 A2 | 2/2000 |
| WO | WO 93/13936 | 7/1993 |
| WO | WO 99/48677 | 9/1999 |

OTHER PUBLICATIONS

"Sideweld Servo Wicketers Single or Double Lane", Hudson–Sharp Converting Equipment, 8 pages.
"Twin Lane Bag Machine, M–1106 TW", FMC, 4 pages.

* cited by examiner

*Primary Examiner*—John Sipos
(74) *Attorney, Agent, or Firm*—Wood, Phillips, Katz, Clark & Mortimer

(57) ABSTRACT

A block of bags for a product filling process includes a plurality of bags stacked in overlying relationship. Each bag of the block has a top edge, a bag mouth and opposite first and second side edges. First and second weakened segments extend from adjacent edge points on respective opposite lateral edges of the bag. A central line of perforations extends between inner ends of the first and second weakened segments. A tear-off region is defined between the central line of perforations and the top edge. During automatic filling of the bag, the weakened segments are torn to form an open bag mouth, and the central line of perforations is torn after filling to separate the bag from the block. The weakened segments can be cuts and are spaced from the lateral edges of the bag to define frangible bridges at the lateral edges, wherein the frangible bridges are broken during opening of each bag. The invention also provides a bag filling platform which holds bag lip portions at a depressed elevation so that lip portions that remain on the platform after bags are separated do not interfere with the filling of subsequent bags.

8 Claims, 19 Drawing Sheets

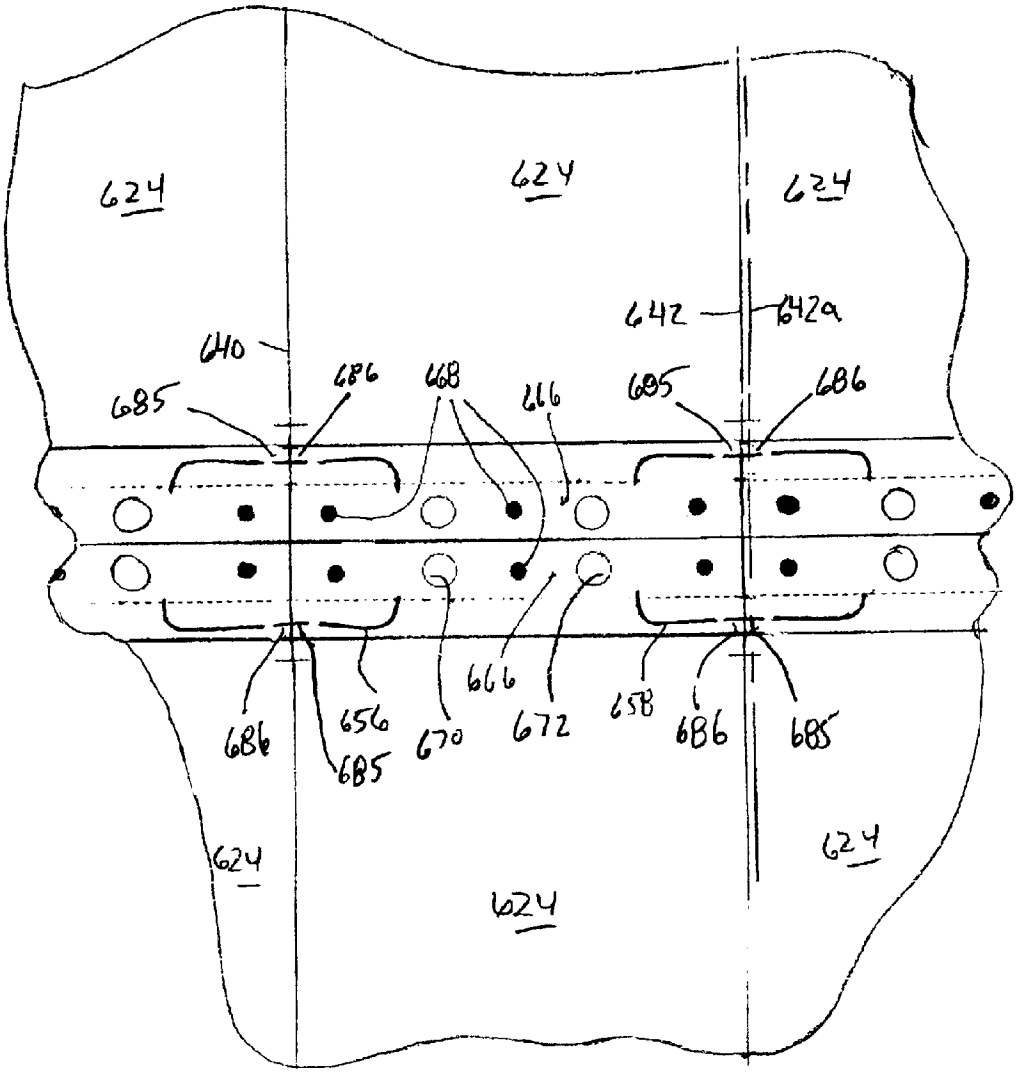
624
624
624
624
624
624
686
686
686

BAG BLOCKS

This application is a continuation-in-part of U.S. Ser. No. 09/785,795 filed Feb. 16, 2001, now U.S. Pat. No. 6,601,707 and claims the benefit of Provisional Application No. 60/300,047 filed Jun. 21, 2001, and Provisional Application No. 60/300,958 filed Jun. 26, 2001.

TECHNICAL FIELD OF THE INVENTION

The invention relates to thermoplastic bags that are stacked and blocked or unitized to be configured as a bag block. The bags can be stacked and/or dispensed using pre-punched holes (wicketed bag blocks), or stacked without use of such pre-punched holes (wicket-less bag blocks). Furthermore, the invention relates to a method of successively filling the bags and separating the filled bags from the bag block.

BACKGROUND OF THE INVENTION

Bag blocks are used in food packaging assembly lines for bagging successively delivered products such as bread loaves. The prior art related to the subject matter of the present invention includes U.S. Pat. Nos. 4,451,249; 4,342,564; and 4,699,607; PCT publication WO 99/48677; and European Patent EP 1 036 741, all herein incorporated by reference.

One conventional approach followed in producing a block of bags from folded or tubular webs of thermoplastic material is to seal and sever the web at equal intervals to produce a succession of bags which may be collected in a stack containing a desired number of bags. This approach may include concurrently processing more than one web strip to substantially increase the number of bags per unit time, a bag stack being generated from each web strip.

Particularly, the approach can involve sealing and severing tubular webs to produce a sheet having its marginal edges closed, defining a pillow. Each sheet is provided, at its medial zone, with spaced-apart lines of perforations and a succession of sheets are accumulated on a flat belt conveyor. Thereafter, the accumulated sheets are transported to a blocking and punching unit by the conveyor. At the blocking and punching unit a heated blade is passed through the sheets centrally between the lines or perforations, and substantially concurrently, a pair of wicket holes is formed on each side of the blade and between the lines of perforations, producing two wicketed bag blocks. The blocks can be carried by posts projected through the wicket holes. A bag can be dispensed from a block, being detached along the line of perforations, which defines the mouth of the bag.

In the manufacture of bag blocks, another approach is described in U.S. Pat. No. 4,699,607 which involves producing two bags from each web segment or sheet wherein each segment is provided with a line of perforations defining a generally circular enclosed area located equidistant from the opposed edges of the sheet. A stack of such sheets is carried by a support, supporting a central medial band of the sheets. The sheets are unitized or blocked by a heated member projecting through the sheets in the perforated circular area of the sheets. To produce individual bag blocks, the sheet stack is cut along a line through the central medial band of the sheets.

For a wicketed bag stack, holes can be pre-punched into the sheet within or outside of the circular perforated area, before the sheets are stacked, and posts are provided on the support for receiving the succession of sheets impaled thereon via the pre-punched holes. The subsequently blocked stack of wicketed bags is moved to a filling station wherein bags can be dispensed from the bag block by tearing individual bags from the bag block.

While U.S. Pat. No. 4,699,607 describes a manufacturing method wherein two bag blocks are formed simultaneously from a stack of double bag segments, which are subsequently separated into individual bag blocks, it is also known to form a single bag block in a similar fashion from a stack of single bag segments.

Another method of forming a bag block follows the following steps:

- unwinding a layer of flat web of film from the unwind stand;
- folding the web of film over a folding board;
- applying a gusset in the web of film;
- entering the web of film into the bag forming machine via the infeed section;
- passing the intermittent moving part of the bag forming machine
- whereby a number of operations are done to the web, including the application of a perforation pattern;
- forming the bags by means of a sideweld or mixed weld sealing head;
- picking up and stacking bags on an index conveyor or an automated wicket handling system; and
- unitizing the stack of bags.

The unwind step can be accomplished by a standard Hudson-Sharp Machine Co. model SDU 1600 unwind stand. It is an electrical surface-driven and braked unwind with a compensator for perfect web tension control. A web guiding system ensures a centered web exiting the unwind stand.

The pre-centered web is pulled over the folding board by the infeed section of the bag machine, thereby forming a J-folded web whereby the lip is typically 35 to 45 mm wide. The folding board is a standard Hudson-Sharp Machine Co. 1500 mm folding board accessory. Optionally a bottom gusset is formed in the J-shaped web. The gusset former is a standard Hudson-Sharp Machine Co. 750 mm gusset former accessory.

The infeed section is the first section of the Hudson-Sharp Machine Co. model 4750W basic wicket machine. It pulls the J-folded web into the bag machine from the gusset former, folding board and unwind by means of a set of nip rolls typically driven by an AC motor. This AC motor is controlled by a frequency controller which obtains a speed reference from the main machine controller and the infeed dancer which is part of the infeed section and located just stream downwards of the nip rolls.

As a standard feature on the Hudson-Sharp Machine Co. model 4750W basic wicket machine, the intermittent moving part of the machine consists of two sets of servo driven nip rolls. In between the two pairs of nip rolls several attachments will modify the web of film such as by punching wicket holes for stacking and/or will detect the photo-eye mark for print registration. The formation of the bag is done in the sealing section of a standard Hudson-Sharp Machine Co. model 4750W. Typically the seals are side seals but mixed weld seals are also possible.

The picking up and stacking of the bags is done in the pick-up and conveyor section of a standard Hudson-Sharp Machine Co. model 4750W. Wicketed bags have wicket holes. Wicket holes have heretofore been circular, triangular, star shaped, or diamond shaped. The bags are stacked on wicket pins going through the wicket holes during stacking. Although this stacking method produces the most ordered stacking quality, it isn't a necessity. The bags can be made without any kind of stacking holes and be stacked on needles. The unitizing of the stack can be done with a standard Hudson-Sharp Machine Co. pin blocker. Accordingly, heated pins can be driven through the stack of bags. The unitizing is done in the lip area above a region of perforations. The subsequently blocked stack of wicketed bags is moved to a filling station wherein bags can be dispensed from the bag block by tearing individual bags from the bag block. During the filling operation perforations are broken to create an opening of each bag large enough to receive the product being packaged.

A method of filling and separating successive bags is described by the following steps:

putting a stack in a stack recipient box and indexing the box to the bag filling area;

opening the bag with an air nozzle or suction device;

inserting the bag opening device or spoons;

inserting the product into the bag;

pulling the bag off the stack together with the product; and closing the bag and putting the bag on an offload conveyor.

The Ibonhart model IB 360 filler feeds each stack of bags into the filling area by means of a recipient box. In a preparation station, an operator puts a stack of bags into a recipient box. When the recipient box in the filling area is empty, it is transferred away from the filling area and a prefilled new recipient box is placed into the filling position. In this process the stacks are presented substantially horizontally in the recipient box. A slight downward angle in the gusset area (i.e., bottom area of the bags when oriented upright) can be applied to lower the gusset area.

Once the filling starts or restarts, bags are removed from the recipient box in the filling station. An air blast, aimed towards the opening of the top bag initially opens the top bag. Once the bag is opened, a set of spoons is inserted into the bag. The spoons engage the mouth of the bag and open it to a somewhat rectangular shape which corresponds to the shape of the product to be packaged. At this moment the bag is held by the spoons but is still connected to the rest of the stack by means of the wicket wire via the wicket holes. By means of a pusher the product is pushed into the bag. When the product hits the bottom of the bag, the still moving pusher will rip off the bag from the stack over the wicket wire. According to another known method, the spoons open the bag and then draw the bag in a reverse direction to the direction the spoons entered the bag, i.e., in a forward direction, to separate the bag from the block and at the same time to capture a stationary product within the moving bag. According to either method, the product together with the bag is then brought into another area of the filler where the bag is closed and transported for further handling.

As the stack is depleted, the recipient box is moved vertically upward to maintain an equal filling plane. The filled bag is pulled off the stack, over the wicket wires. Since the bag is completely removed after each fill, the top of the remaining stack has full clearance without leaving any scrap which could interfere with the filling process. However, the entire lip is removed with the bag that can constitute an undesirable extra flap connected to each bag.

Another method of filling a succession of bags is described in Australian published application AU 20002280 A1. According to this reference, a stack of bags is positioned on a support. The stack is held on holding rods and a flap region of the stack is clamped to the support. In this disclosure, the act of opening the bag breaks angularly oriented lines of perforations and substantially severs the top bag from corner portions of the bag flap entirely or except for short unperforated parts adjacent to the top edge of the bag. A product, such as a loaf of bread, is inserted into the open mouth of the bag and the bag with product inside is separated from the corner portions of the bag flap by breaking the short unperforated parts if they are present. A considerable amount of flap material is included with the separated bag. As the height of the bag decreases, the stacking table is moved up against the clamping plate.

While unitized bag stacks such as described above have been in widespread use, some aspects of their use can still be problematic. If unitized portions of each bag stack remain after the bag stack is depleted, this scrap material must be removed so that a new bag stack can be put in place for automatic loading. If each bag stack creates plural pieces of scrap material, removal is undesirably complicated. The aesthetic appeal of each package can also be diminished if that portion of the rear wall of each bag which provides unitizing remains, in whole or in part, joined to the filled bag. The open mouth of the bag has a generally uneven appearance, with the rear wall portion of the bag extending beyond the front wall portion. The rear wall portion may include wicket holes or the like, thus further detracting from the aesthetic appeal of the package.

The present inventor has recognized the desirability of providing bags to be dispensed from a block of bags, wherein the bags are unitized in a bag block, each bag having a lip, wherein individual bags can be removed from the block with a minimized portion of the lip connected to the separated bag.

The present inventor has also recognized the desirability of providing a method of filling such bags, wherein the bags are filled and successively torn from the block, wherein the lip portions remaining on the block do not interfere with the filling of subsequent bags.

The present inventor has also recognized the desirability of providing a block of bags which dispenses individual bags with a minimized and consistent bag opening force and a minimized and consistent tear off force.

SUMMARY OF THE INVENTION

The present invention contemplates an improved design for wicketed and wicket-less blocked bag stacks or "bag blocks" wherein a top bag of the block is removed from the stack with a minimum waste of web material, and with a minimized but precise tear off force and a reliable bag opening force.

The present invention contemplates an improved design for wicketed and wicket-less blocked bag stacks or bag blocks wherein the bags are unitized within a lip or flap area thereof, and wherein a top bag body of the block is removed from the stack with a minimally-sized lip portion of web material adjoined thereto.

The present invention is directed to a stack or block of bags comprising a plurality of bags stacked in overlying relationship. Each of the bags has front and rear walls which define a bag mouth, a top edge of the bag, and first and second opposite lateral edges. The bag mouth is defined at a top edge of the front wall, with the back wall extending beyond the front wall to generally define a tear-off region.

According to one aspect of the invention, two weakened segments such as two edge lines of perforations extend inwardly from edge points on respective side edges of the bag, for a short distance. A central weakened segment such as a center line of perforations extends between the two edge lines of perforations, offset from the edge points toward a top edge of the bag. Preferably, the central line of perforations is less easily torn than the two edge lines of perforations. The edge lines of perforations can be perpendicular to the side edges and parallel to the central line of perforations, or can be oblique to the side edges and to the central line of perforations. The central and two edge lines of perforations can be joined together by oblique or perpendicular line segments or curve segments of perforations, preferably being perforations which are easily torn, similar in degree to the tear strength of the first and second edge lines of perforations.

Pluralities of such bags are collected in a stack. A hot plate or pin is driven through corner lip areas defined by the adjacent side and top edges of each bag, and the two lines of perforations, and a hot plate or pin is driven through a central lip area defined between the top edge and the central line of perforations, to unitize or block the stack of bags.

This embodiment can be incorporated into a wicket-less or wicketed bag. In the case of a wicketed bag, two wicket holes can be provided between the top edge and the central line of perforations.

During a filling operation, the top bag is opened from a flat to a rectangular or pillow configuration with a substantially rectangular open mouth, adjacent to the lip. During the opening, the two edge lines of perforations, which are easily torn, separate or tear to accommodate the rectangular shape of the mouth. After the bag is filled, it is forcibly torn along the central line of perforations to separate the bag body from the bag block. The bag once separated includes only a short lip portion, taken in a longitudinal direction of the bag. The bag block retains the remaining lip portion from the separated bag. As more bags are removed, the remaining lip portions of the previously separated bags can become an obstacle to filling subsequent bags, unless inventive apparatus are utilized.

In this regard, according to another aspect of the invention, the bag block is held on a support platform during filling, wherein the support platform includes an obliquely oriented lip support with an associated clamp that holds the remaining lip portions to the lip support. The remaining lip portions are held below the elevation of the bottom bag, such that remaining lip portions will not interfere with filling the entire stack of bags, beneath the original top bag.

In another aspect of the invention, two substantially rectangular corner tear-off regions are provided at the upper corners of a bag. The corner tear-off regions are each substantially defined by one lateral edge of the bag, the top edge of the bag, one edge line of perforations as described in the first embodiment, and one of two short lines of perforations extending substantially from the one edge line of perforations to the top edge of the bag.

Wicket holes can be provided within a central region of the lip. A hot plate or pin is passed through the stack of bags, within each of the corner tear-off regions, and through the central region of the lip, to unitize the stack of bags as a bag block.

The corner tear-off regions are removed before the block reaches a filling station. Preferably, plural stacked corner regions are removed together from a formed bag stack or bag block by clamping the corner regions and clamping the remaining bag stack or block separately and differentially moving the two clamping mechanisms to separate the corner regions from the stack or block. Alternately, the corner regions are removed from each bag during bag formation on the bag forming machine. The corner tear-off regions are clamped, and the remaining bag is separately clamped. Using differential movement between the clamps, the corner regions are removed from the bag by tearing along the perforations. It is also possible that the bag block with corner regions attached thereto is shipped to the filling station, such as a bakery, where the corner regions are removed prior to or during filling. The corner tear-off regions are removed before the filling operation to facilitate the initial opening of the bag mouth from a flat condition to a rectangular shape.

According to another aspect of the invention, a bag stack comprising a plurality of bags, wherein each bag includes a rear wall portion which extends beyond the associated front wall portion to define a tear-off region. The tear-off region is completely separated from the bag during automatic loading, thus enhancing the aesthetic appeal of the bag. Additionally, the tear-off regions are connected, such as by unitizing, into a single piece or block of scrap material for each bag stack, thus facilitating efficient removal of the scrap material during automatic bag loading.

According to another aspect of the invention, a bag stack comprises a plurality of bags, wherein each bag includes a rear wall portion that extends beyond the associated front wall portion to define a tear-off region. The tear-off region is completely separated from the bag during automatic loading, thus enhancing the aesthetic appeal of the bag. Additionally, the tear-off regions are connected, such as by unitizing, into a single piece or block of scrap material for each bag stack, thus facilitating efficient removal of the scrap material during automatic bag loading.

According to another aspect of the invention, a central weakened segment such as a central line of perforations defined by the back wall, spaced from the top edge thereof, defines the tear-off region of the rear wall. First and second weakened segments, such as elongated openings in the rear wall respectively extend from opposite ends of the central line of perforations toward the first and second opposite lateral edges. By this construction, the tear-off region of each bag can be substantially completely separated from the body of the bag during automatic loading. Each bag includes at least one unitizing area in the tear-off region, with the unitizing area connecting the bags of the stack to each other.

In accordance with one illustrated embodiment, the central line of perforations, and each of the first and second elongated openings are aligned with each other, and extend laterally of each bag. In the exemplary form, each of the first and second elongated openings extends substantially completely between the central line of perforations, and the respective one of the first and second lateral edges.

In a particularly exemplary form, each bag includes a pair of fracturable residual regions respectively positioned at the ends of the first and second elongated openings, at the first and second lateral edges of each bag. These residual regions can be formed as the bags are separated from the web of material from which they are formed, such as by use of a hot knife or like tool. Separation in this fashion acts to form the desired residual region at the end of each elongated opening, at the respective lateral side edge, thus desirably acting to stabilize and preclude flapping or the like of the tear-off region adjacent to each elongated opening.

In accordance with illustrated embodiments, the elongated openings in each bag may comprise an elongated slot, or an elongated slit.

According to another aspect of the invention, a central weakened segment formed by a line of perforations extends across the bag inwardly, perpendicularly to the side edges. Two weakened segments comprising L-shaped cuts extend inwardly from side edges of the bag from a position below the line of perforations to a position close to, or overlapping the line of perforations. The L-shaped cuts are located adjacent a cut recess at each edge of the bag. The cut recess can be formed by a punched hole through the mutual edge of adjacent bags being formed and eventually forms a recess region of the lateral side edge of the bag. Preferably the recess is semi-circular and is cut at the same time that the L-shaped cut is made to ensure a web or bridge having a precise and consistently reliable length between the L-shaped cut and the recess.

Pluralities of such bags are collected in a stack. A hot blade is driven through top tear off region defined by the adjacent side and top edges of each bag, and the line of perforations, to unitize or block the stack of bags. This embodiment can be incorporated into a wicket-less or wicketed bag.

Rather than the hot blade penetrating through the tear off region, the stack of bags can be unitized by a hot blade being applied to a top edge of the stack of bags. Either a flat blade or a cylindrical pin can be used to unitize a top region of the stack. Alternatively, the wicket hole itself can be the location of unitizing around its inner circumference. Furthermore, rather than a single flat hot blade unitizing a flat region of the stack of bags, a plurality of hot pins, arranged in parallel, can be applied to a top surface of the stack of bags in order to unitize the bag stack It may be important in some applications, particularly in an assembly line bag filling operation, that each successive top bag from a bag block is opened into a tube or pillow shape, filled and removed with minimum and precise forces.

During a filling operation, the top bag is opened from a flat to a rectangular or pillow configuration with a substantially rectangular open mouth, adjacent to the lip. During the opening, the two bridges or webs, which are easily torn, tear to accommodate the rectangular shape of the mouth. After the bag is filled, it is forcibly torn along the central line of perforations to separate the bag body from the bag block. The bag once separated includes only a short lip portion, taken in a longitudinal direction of the bag. The bag block retains a tear off portion of the separated bag.

The precise and consistently reliable length of the web or bridge between the L-shaped cut and the recess ensures a consistent and reliable breakage force of this bridge during the opening of the bag to a tube shape, before filling with product. After the webs are broken during tube formation, and the bag is filled, the portion of the line of perforations located between the L-shaped cuts is torn with a minimum of force. The direction of the tear off force is perpendicular to the line of perforations so that the stress on the residual web material is tensile stress.

Numerous other advantages and features of the present invention will become readily apparent from the following detailed description of the invention and the embodiments thereof, and from the accompanying drawings.

BRIEF DESCRIPTION OF THE DRAWINGS

FIG. 16 is an enlarged fragmentary view of an alternate embodiment to the arrangement shown in FIG. 14.

DETAILED DESCRIPTION OF THE PREFERRED EMBODIMENTS

Figure 1:
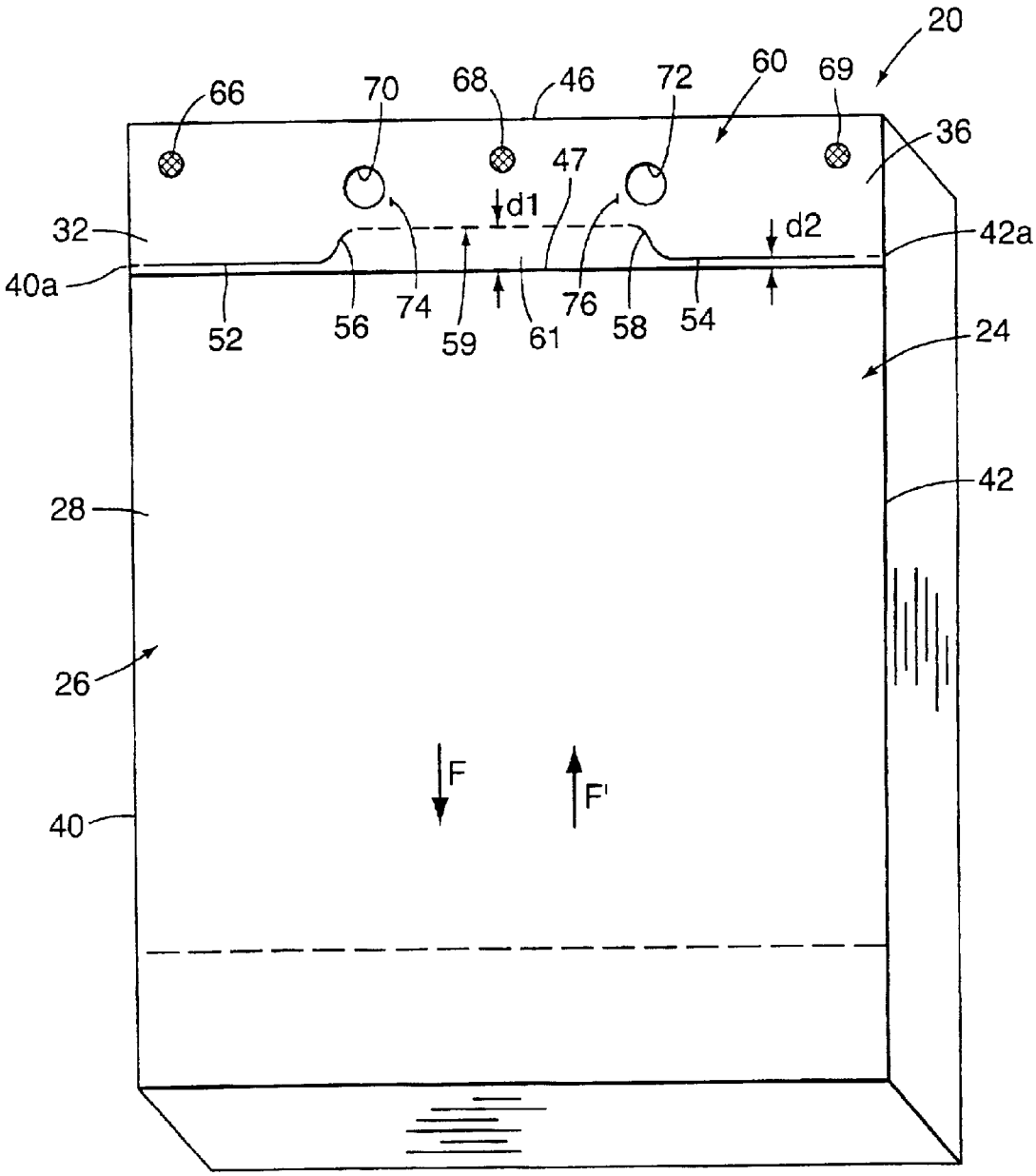
FIG. 1 is a perspective view of a first embodiment stack of bags in accordance with the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Exemplary apparatus for manufacturing, stacking and blocking bag stacks are described in the aforementioned U.S. Pat. No. 4,699,607. U.S. Pat. No. 4,903,839, hereby incorporated by reference, as well as Australian Patent Application No. 200022280, published Sep. 21, 2000, also hereby incorporated by reference, illustrate various configurations of stacked or blocked bags suitable for use with automatic loading machines. The present invention is directed to an improved arrangement of blocked bags which facilitates efficient manufacture, automatic loading, and provides an aesthetically pleasing bag for packaged products.

FIG. 1 illustrates a block 20 of bags 24 according to a first embodiment of the invention. Each bag 24 includes a tubular body 26 having a front wall 28 and a back wall 32 which extends upwardly of the front wall, forming a back wall top flap or lip 36. The bag body has first and second sealed or fold-formed side edges 40, 42, a top edge 46, and a bag mouth 47.

Extending perpendicularly and inwardly from a first edge point 40*a* on the first side edge 40, is a first weakened segment in the form of a first edge line of perforations 52. Extending perpendicularly and inwardly from a second edge point 42*a* on the second side edge 42, is a second weakened segment in the form of a second edge line of perforations 54. The first and second edge points 40*a*, 42*a* can be located on or very close to the bag mouth 47. A first angular segment of perforations 56 extends from an end of the first edge line of perforations 52, obliquely toward the top edge 46. A second angular segment of perforations 58 extends from an end of the second edge line of perforations 54, obliquely toward the top edge 46. A central weakened segment in the form of a central line of perforations 59 extends between ends of the segments of perforations 56, 58. The central line of perforations 59 can be located at a distance d1 from the mouth 47 that is greater than a distance d2 between either the first and second edge points 40*a*, 42*a* and the mouth 47. Advantageously, this distance d1 is about 10 to 15 mm.

A lip tear-off region, or distal lip portion, or remaining lip portion 60 is defined by the lines of perforations 52, 54, 56, 58, 59, the side edges 40, 42, and the top edge 46 of the bag body 26. A bag lip portion 61 is defined by the lines of perforations 52, 54, 56, 58, 59, the side edges 40, 42, and the bag mouth 47. A unitizing area 66 is formed through the stack 20 within the lip tear-off region 60, between the top edge 46 and the line 52, substantially perpendicularly to the plane of the back wall 32. A second unitizing area 68 is formed within the lip tear-off region 60 between the edge 46 and the line 59, and through the stack 20, substantially perpendicularly to the plane of the back wall 32. A third unitizing area 69 is formed within the lip tear-off region 60 between the edge 46 and the line 54. The first, second and third unitizing areas 66, 68, 69 are formed by penetrating the stack 20 with one or more hot plates or pins, which form holes through the stack and melt-fuses together the bags 24 within the areas 66, 68, 69. It is possible that the holes formed within the areas 66, 68, 69 can be made large enough to subsequently receive rods for guiding or supporting the stack.

Wicketing holes 70, 72 and/or pin holes 74, 76 can be located within the lip region 60 which are utilized as described in U.S. Pat. No. 4,699,607 or U.S. Ser. No. 09/517,968 filed Mar. 3, 2000. The wicketing holes 70, 72 and/or the pinholes 74, 76 act in conjunction with posts and/or sharpened pins to align bags during stack formation. Subsequently, the wicketing holes 70, 72, or the holes formed within the areas 66, 68, 69, can receive wires, posts or rods to guide and/or support the stack and allow individual bags to be torn from the stack.

It is advantageous that the line of perforations 59 is perpendicular to the tear-off or pull direction F, or an alternate pull direction F', when a user or automated equipment is separating a bag 24 from the stack 20. In this way, maximum tensile stress is exerted on residual web material along the perforated line 59.

Although the edge lines of perforations 52, 54 are shown to be perpendicular to the side edges 40, 42, and parallel to the central line of perforations 59, it is also encompassed by the invention that the edge lines of perforations 52, 54 are oblique to the side edges 40, 42, extending at an acute angle to the side edges from the points 40*a*, 42*a* toward the central line of perforations 59.

Figure 2:
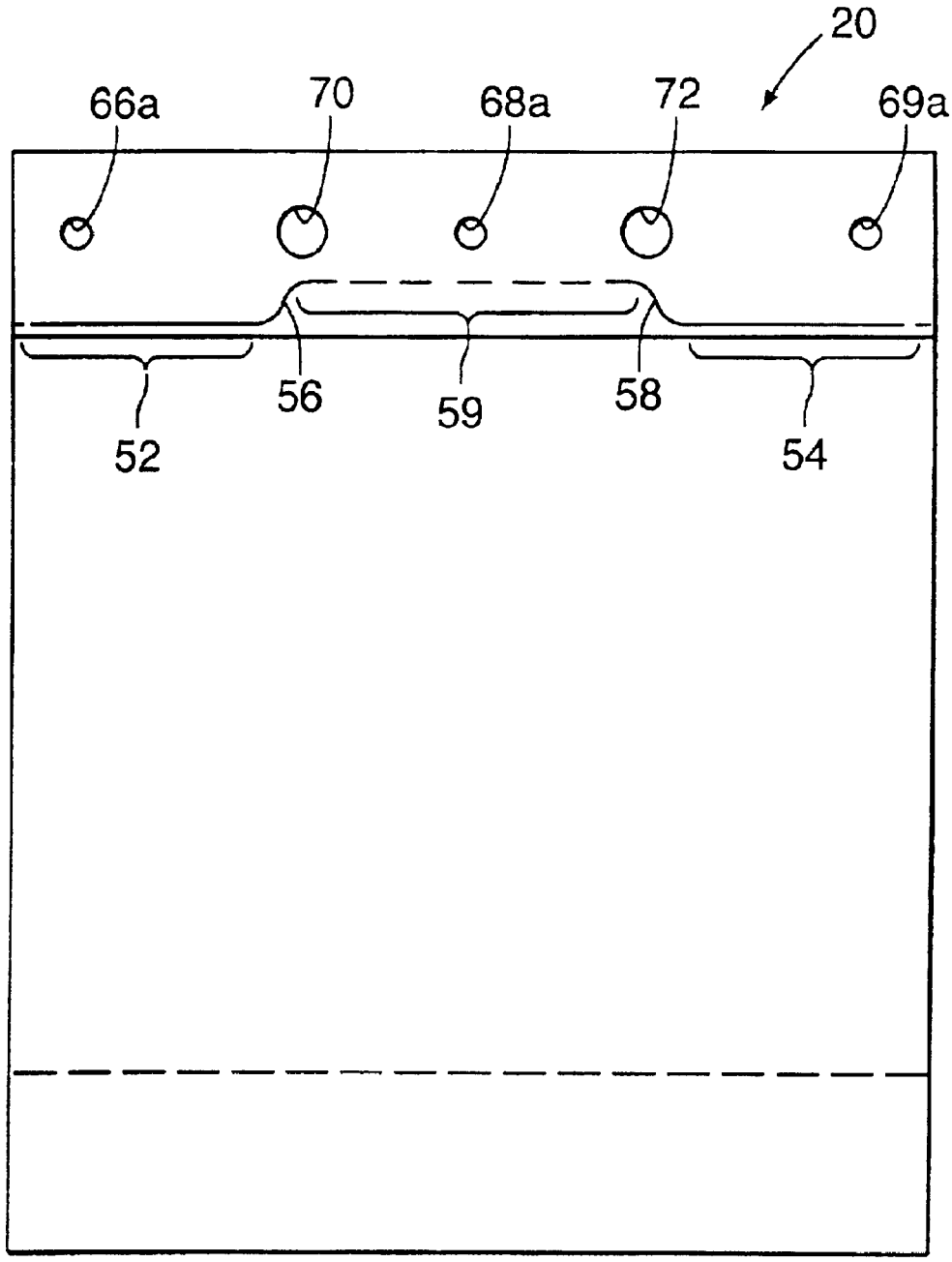
FIG. 2 is a plan view of the first embodiment stack of bags of FIG. 1, shown in a prior stage of manufacture.

FIG. 2 illustrates the first embodiment of the invention in a prior stage of assembly. In this stage, the step of forming the unitizing areas 66, 68, 69 is optionally preceded by pre-drilling or otherwise forming holes 66*a*, 68*a*, 69*a*. This assists the hot plates or pins rods in penetrating and unitizing the stack through the holes 66*a*, 68*a*, 69*a*.

Figure 3A:
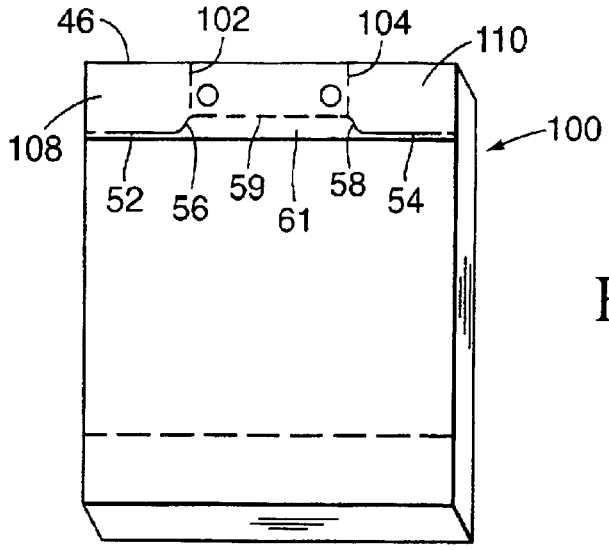
FIG. 3A is a plan view of the second embodiment stack of bags in accordance with the present invention, in a first stage of manufacture.
Figure 3B:
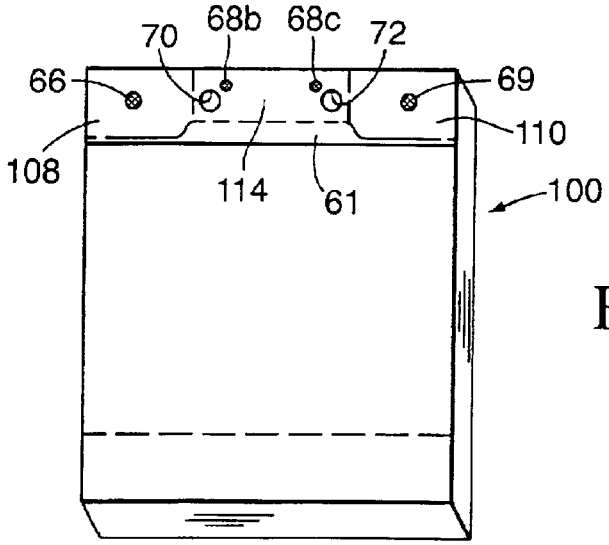
FIG. 3B is a plan view of the second embodiment stack of bags in a second stage of manufacture.
Figure 3C:
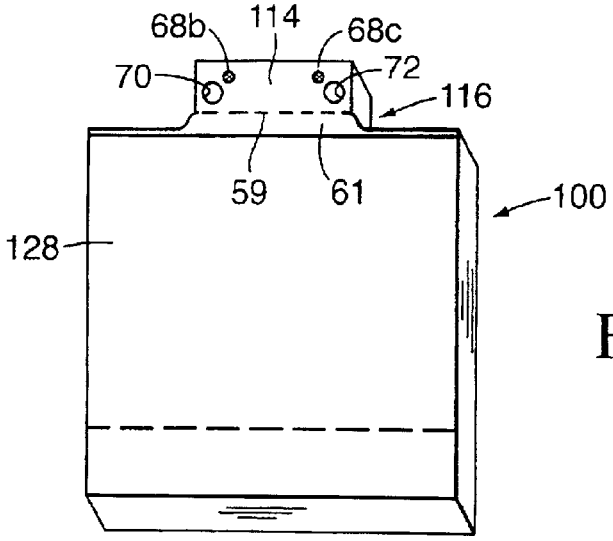
FIG. 3C is a plan view of the second embodiment stack of bags in a third stage of manufacture.

FIGS. 3A–3C show an alternate embodiment bag block 100 in three stages of manufacture. Those features of the alternate bag block 100 which are identical to features in the previously described bag block 20 are identified with like reference numerals. The alternate bag block 100 includes substantially longitudinal weakened segments such as longitudinal lines of perforations 102, 104 which substantially extend from ends of the central line of perforations 59 to the top edge 46 of the bag block. The substantially longitudinal lines of perforations 102, 104, the angular segments of perforations 56, 58 and the edge lines of perforations 52, 54 form corner tear-off regions 108, 110 respectively.

Although the substantially longitudinal lines of perforations 102, 104 are shown to be perpendicular to the central line of perforations 59, it is also encompassed by the invention that the substantially longitudinal lines of perforations can be obliquely angled to the longitudinal direction such as being angled toward each other toward the top edge of the bag.

FIG. 3B illustrates the bag block 100 of FIG. 3A, but further including central unitizing regions 68*b*, 68*c* located within a central lip region 114 that is located between the tear-off corner regions 108, 110.

FIG. 3C illustrates the bag block 100 of FIG. 3B with the corner regions 108, 110 removed. The central lip region 114 is unitized throughout the stack by the regions 68*b*, 68*c*. The central lip region 114 can be held by wickets through the wicket holes 70, 72 or by other means as described below during dispensing of the bags at a filling station. As each bag is filled it is then removed by separation along the central line of perforations 59. Because the corner regions are removed, each successive top bag can be opened into a rectangular configuration easily.

Figure 4A:
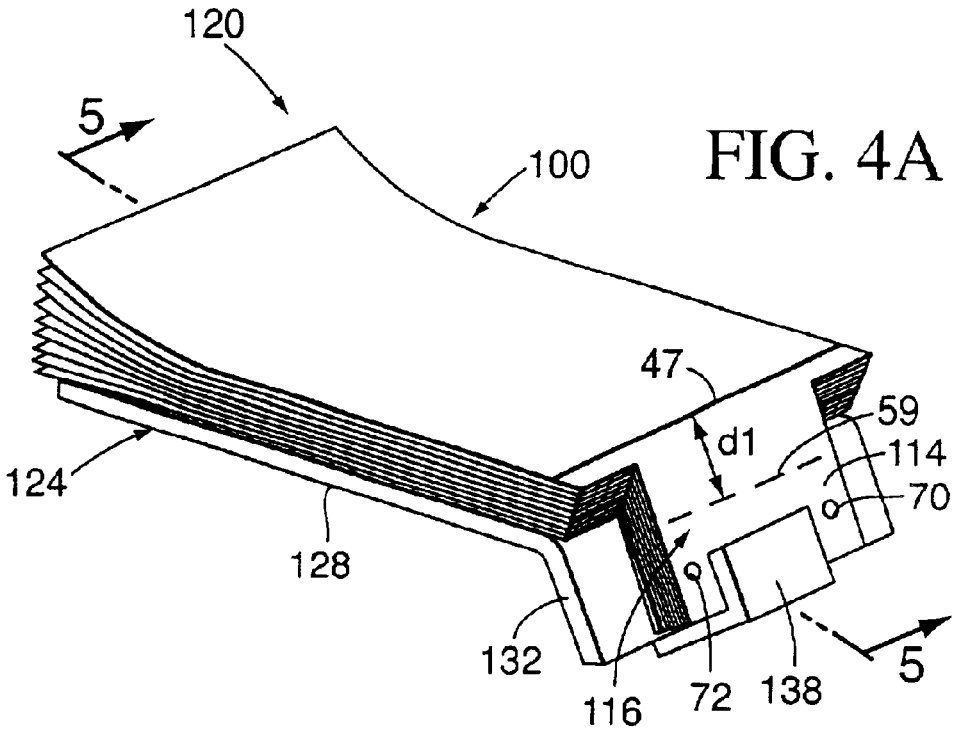
FIG. 4A is a perspective view of a bag filling apparatus of the invention in a first stage of operation.

FIG. 4A illustrates the block 100 in a filling station 120 supported on a support table 124. The support table 124 includes a substantially horizontal support plate 128 and an oblique, lip-supporting plate 132. The central lip region 114 is supported on the plate 132 and clamped thereon by a clamp member 138. Alternatively, or additionally, wicket pins 139 supported by a bracket 140 (shown in FIG. 5) can penetrate through a backside of the plate 132 through the wicket holes 70, 72 to hold the lip region 114 on the plate 132.

Figure 4B:
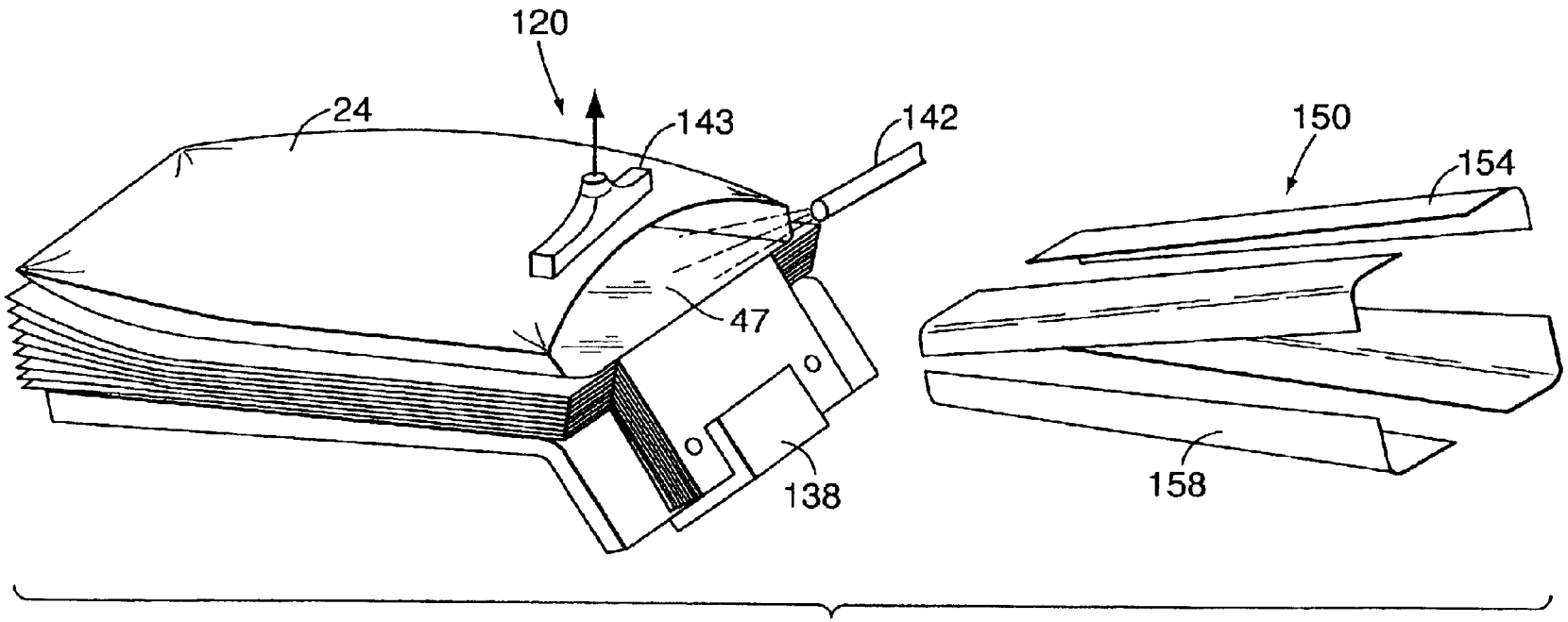
FIG. 4B is a perspective view of the bag filling apparatus of FIG. 4A in a second stage of operation.

FIG. 4B illustrates an air delivery device 142 blowing an air stream onto the top bag 24 particularly into the mouth 47 of the top bag 24. The air stream tends to open the bag from a flat condition to a rectangular or pillow shaped configuration. Alternately, or additionally, a suction device or suction cup 143 can be used to open the mouth 47. The suction device 143 can be configured to engage the bag wall at the mouth and then to move upwardly to open the mouth. An opening device 150 which includes an upper opening mechanism or spoons 154 and a lower opening mechanism or spoons 158 is configured to be inserted into the open mouth 47 of the top bag 24.

Figure 4C:
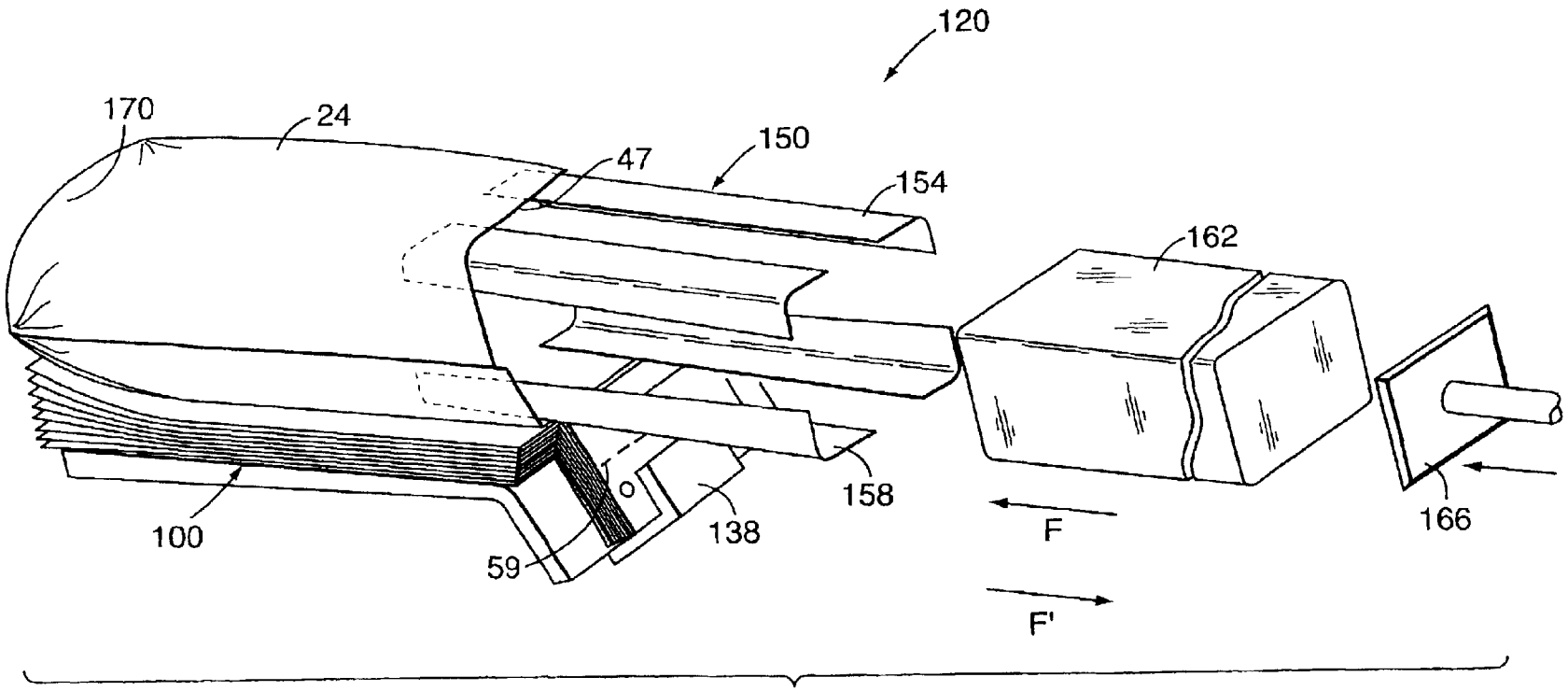
FIG. 4C is perspective view of the bag filling apparatus of FIG. 4A in a third stage of operation.

FIG. 4C shows the opening device 150 inserted into the bag mouth 47 and then having the spoons 154,158 pivoted to expand the device 150 to hold the bag 24 in the open configuration. A product 162 is inserted into the bag 24 through the opening device 150. The product 162 is inserted via a pusher 166 which pushes the product 162 through the bag and against an end wall 170 thereof with a force sufficient to tear the top bag 24 along the perforation line 59 to separate the top bag 24 from the block 100. This force is along the direction F.

Figure 5:
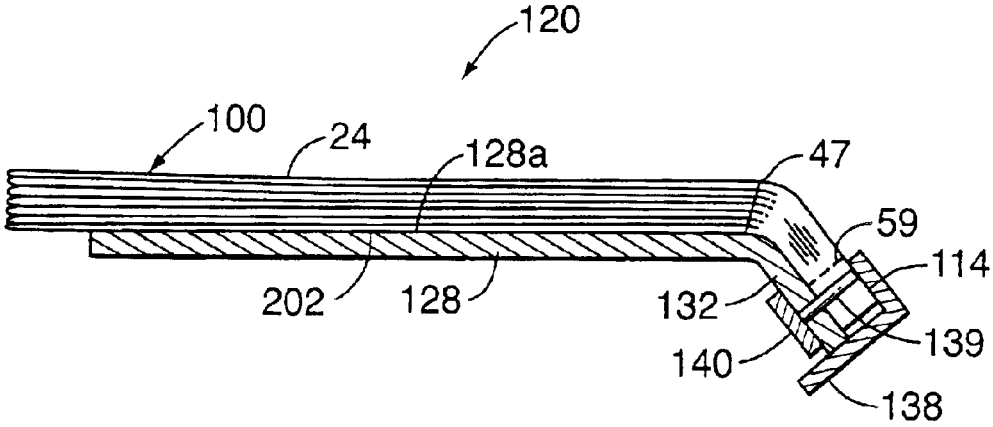
FIG. 5 is a sectional view taken generally along line 5—5 of FIG. 4A.

FIG. 5 illustrates the filling station 120 in section. This figure illustrates that the oblique plate 132 allows the perforation line 59 to be located generally at or below a top surface 128*a* of the support table 128. This allows the succession of bag opening mouths 47 to be located at a higher elevation than the remaining lip regions 114 such that the remaining lip regions 114 do not interfere with the filling of subsequent mouth of the bags down to a bottom bag 202. Although it is advantageous to have the bottom bag 202 located above the remaining lip region 114, it may also be acceptable for overall non-interference to have the remaining lip regions 114 held at an elevation only below some or most, but not all, of the bags in the block. For example, it may be because of the size of the product with respect to the size or shape of the bag mouth that it is only necessary that the remaining lip regions 114 on the plate 132 be below a bag mouth that is only half way down the original block of bags.

According to another known filling method, the spoons open the bag and then draw the bag in a reverse direction to the direction the spoons entered the bag, i.e., in a forward direction, along the line F', to separate the bag from the block and at the same time to capture a stationary product within the moving bag. The apparatus of FIGS. 4A–4C are equally applicable to this method, with the exception of the pusher.

Figure 6:
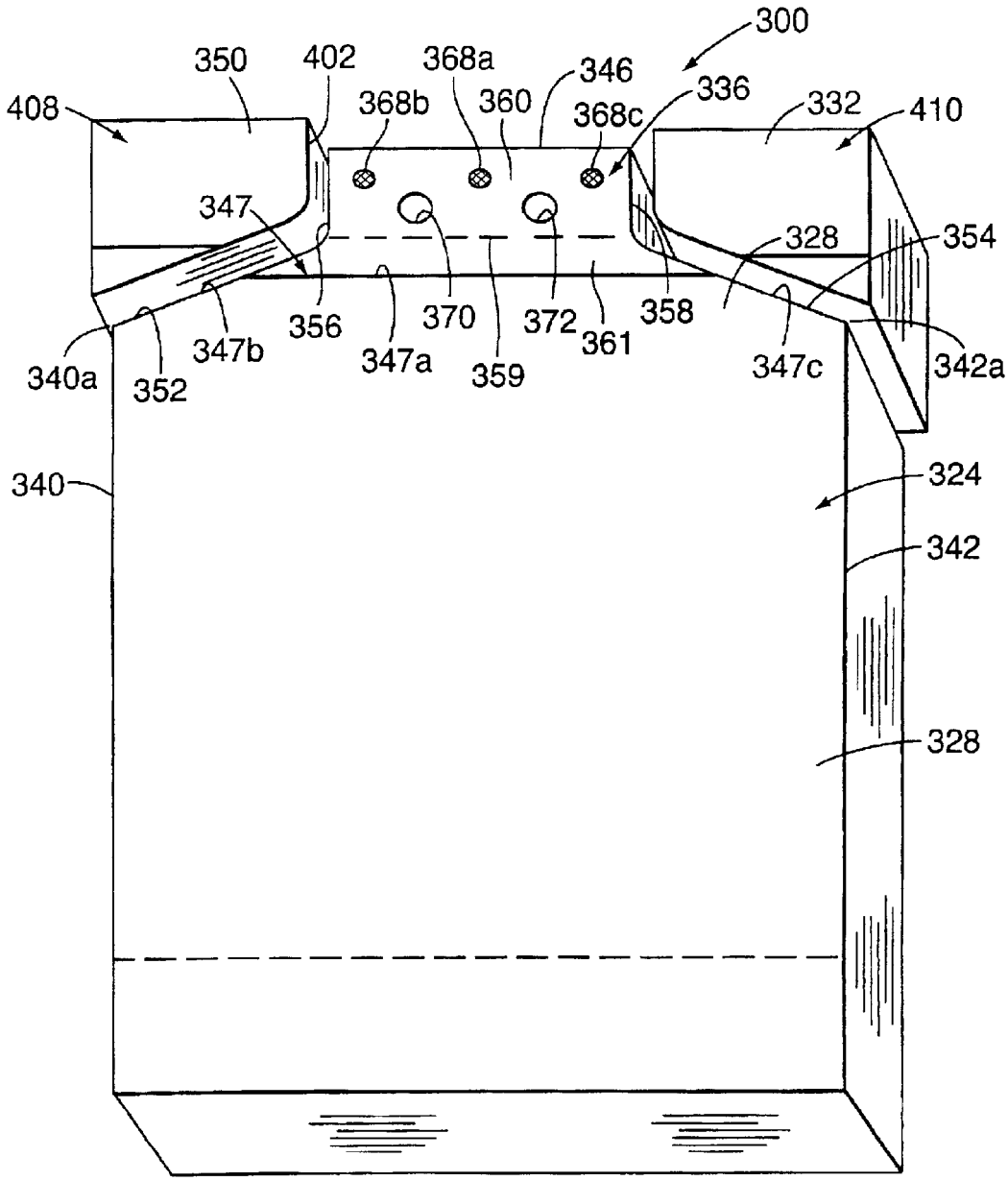
FIG. 6 is a perspective view of a further alternate embodiment bag block of the present invention.

FIG. 6 illustrates an alternate bag block 300. This bag block 300 includes alternate bags 324 having alternate tubular bag bodies 326. Each body 326 includes a front wall 328 and a back wall 332 that extends upwardly of the front wall, forming a back wall top flap or lip 336. The bag body has first and second sealed or fold-formed side edges 340, 342, a top edge 346, and a bag mouth 347. Similar to the bag block 100 described in FIGS. 3A–3C, corner portions 408, 410 are removed from the bag block 300, before the bag block is delivered to a filling station. For purpose of description of the perforations, the corner portions are shown with the bag block, slightly separated therefrom.

Extending obliquely and inwardly from a first edge point 340*a* on the first side edge 340, is a first edge weakened segment such as a first edge line of perforations 352 (shown already broken from the corner portion 408). Extending obliquely and inwardly from a second edge point 342*a* on the second side edge 342, is a second weakened segment, such as a second edge line of perforations 354 (shown already broken from the corner portion 410). The first and second edge points 340*a*, 342*a* are located on or below the original bag mouth 347, i.e., the bag mouth 347 before the corner regions are removed. Before the corners 408, 410 are removed, the edge lines of perforations 352, 354 are formed through the front wall 328 and the back wall 332 of the body 326 at the edge points 340*a*, 342*a*. A first substantially longitudinal weakened segment such as a first substantially longitudinal segment of perforations 356 (shown already broken from the corner portion 408) extends from an end of the first edge line of perforations 352, toward the top edge 346. A second substantially longitudinal weakened segment such as a second substantially longitudinal segment of perforations 358 (shown already broken from the corner portion 410) extends from an end of the second edge line of perforations 354, toward the top edge 346.

The corner regions 408, 410 are removed by breaking the lines of perforations 352, 354, 356, 358. The finished bag mouth 347, once the corner regions 408, 410 are removed, thus includes a laterally arranged central region 347*a* and two oblique edge regions 347*b*, 347*c*.

A central weakened segment such as a central line of perforations 359 extends between ends of the first and second lines of perforations 352, 354. A lip tear-off region, or distal lip portion, or remaining lip portion 360 is defined by the lines of perforations 352, 354, 356, 358, 359, and the top edge 346 of the bag body 326. A bag lip portion 361 is defined by the lines of perforations 352, 354, 359, and the central region 347a of the bag mouth 347.

Unitizing areas 368*a*, 368*b*, 368*c* are formed through the stack of bags 24 within the lip tear-off region 360. The unitizing areas 368*a*, 368*b*, 368*c* are formed by penetrating the stack of bags 324 with one or more hot plates or pins, which form holes through the stack and melt-fuses together the bags 324 within the areas 68*a*, 368*b*, 368*c* as described previously. Wicketing holes 370, 372, or other functional holes as previously described, can be located within the lip region 360.

During a filling operation, the central line of perforations 359 and the wicket holes 370, 372 perform the same function as that described in the prior embodiments.

Figure 7A:
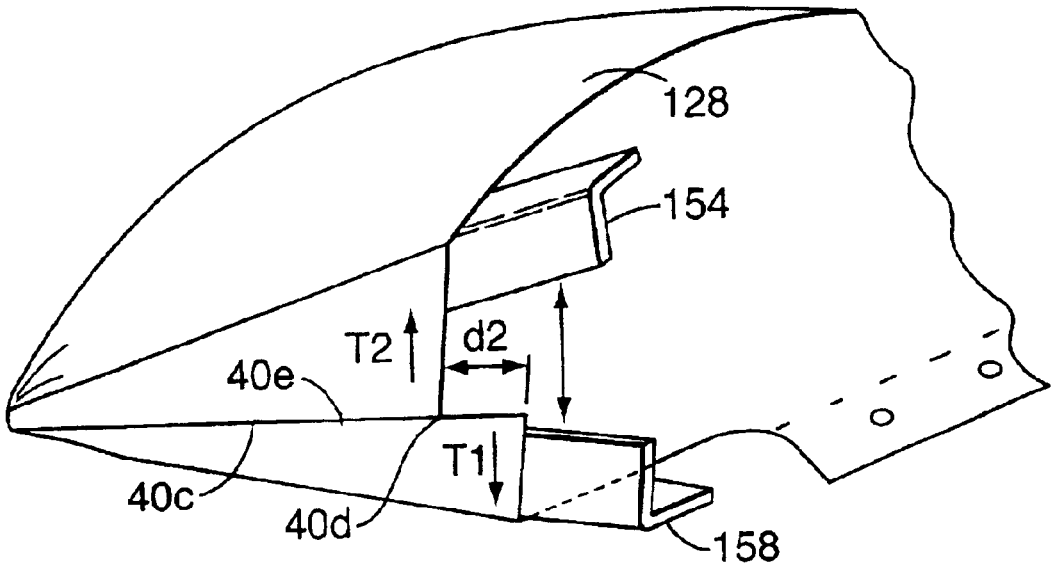
FIG. 7A is a diagrammatic perspective view of a bag being opened as shown in FIG. 4C.
Figure 7B:
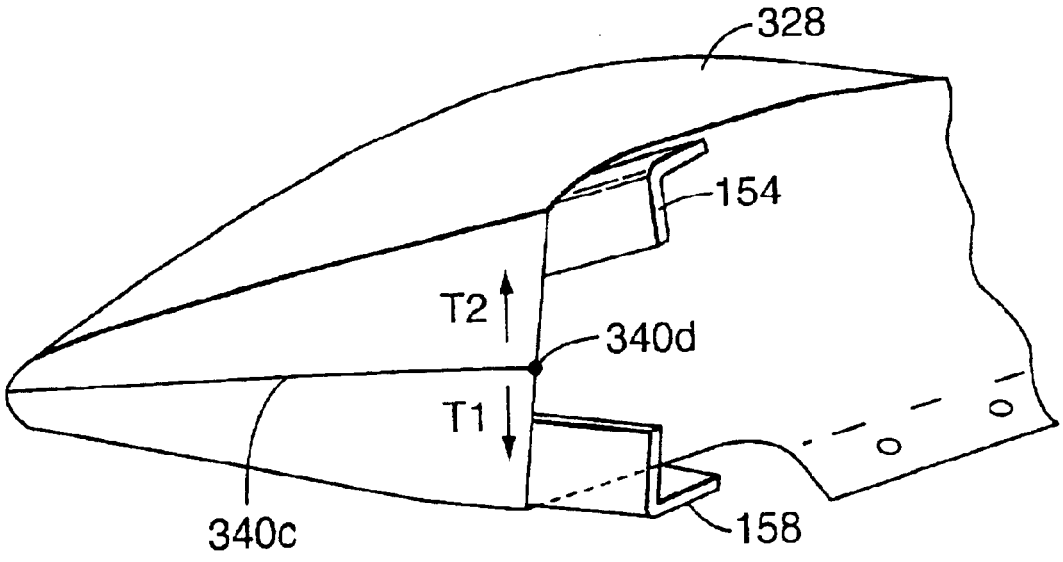
FIG. 7B is a diagrammatic perspective view of a bag being opened, comparable with FIG. 7A, except using a bag from the block shown in FIG. 6.

One advantage of the configuration of FIG. 6 is demonstrated in FIGS. 7A and 7B. FIG. 7A illustrates, in diagrammatic fashion, the opening of a bag body 128 configured in accordance with FIGS. 3A–3C. The spoons 154, 158 stretch open the bag in a vertical direction. This causes an offset loading due to the loads T1 and T2. The load T1 is offset from the load T2 due to the extending lip 61, extending by the distance d2. This offset loading, although small due to the small distance d2, can possibly cause an increased incidence of seal failure along side edge seals 40*c*, at the point 40*d*. Given greater distances d2 than that of the present invention, it has heretofore been known to include a side seal discontinuity or □seal saver□ 40*e* in the side seal 40*c* to stop the propagation of a rip down the side seal during bag opening.

FIG. 7B illustrates that according to the embodiment of FIG. 6, there is no offset loading of T1 and T2 at the side seal 40*c* and no enhanced stress at the point 40*d* to cause propagation of a rip down the side seal. The need for a seal discontinuity 40*e* is obviated.

Although the alternate bag block 100 is shown in use with the filling station 120 in FIGS. 4A–5, the bag block 20 shown in FIGS. 1–2 and 6 can also be mounted on the filling station 120 shown in FIGS. 4A–5 as well. In that application, when the air source 142 opens the bag, the side edge perforations 52, 54 would be broken to allow for the bag to assume a pillow shape or rectangular configuration as shown in FIG. 4B. Additional needs, such as the suction device or suction cup 143 (shown in FIG. 4B) applied on the top layer of the bag and then moving vertically upward, for example, might be necessary to break the edge perforations.

In any of the embodiments of FIGS. 1–2, 3A–3C, or 6, rather than hot plates or pins penetrating through the tear-off region, the stack of bags can be unitized by a hot plate being applied to a top edge of the stack of bags. Either a flat blade or a cylindrical pin can be used to unitize a top region of the stack. Alternatively, the wicket hole itself can be the location of unitizing around its inner circumference. Furthermore, rather than a single flat hot plate unitizing a flat region of the stack of bags, a plurality of hot pins, arranged in parallel, can be applied to a top surface of the stack of bags in order to unitize the bag stack. Such arrangements for unitizing are described in detail in U.S. Ser. No. 09/517,968.

Although melt-fusing is an effective method of unitizing the bag stack, it is also possible to unitize the stack by the use of adhesive, such as applied on the exposed, stacked top edges of the bags in the stack.

Although the embodiments illustrate "lines" or "segments" of perforations as being straight or linear, such lines could also be curved lines or segments without departing from the invention.

Figure 8:
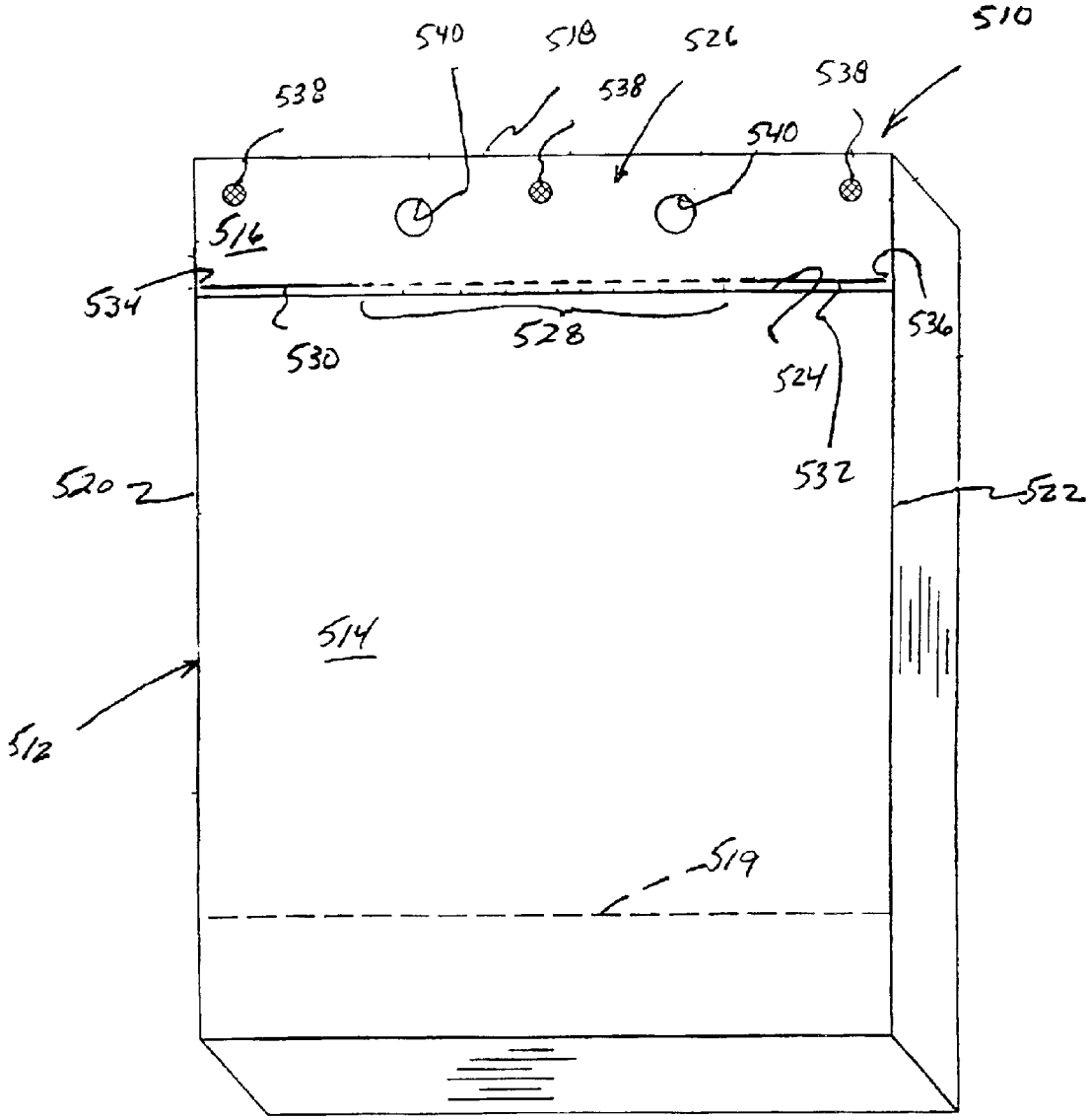
FIG. 8 is a top plan view of a stack or block of bags embodying the principles of the present invention.

Another embodiment is illustrated in FIG. 8. A stack of bags 510 comprises a plurality of bags 512 positioned in overlying relationship, with the bags 512 configured in accordance with the present invention. Each bag 512 includes a generally tubular body comprising a front wall 514 and a rear wall 516, with each bag including a top edge 518 at the end of rear wall 516, and first and second opposite lateral side edges 520 and 522. Each bag 512 may include an inwardly extending bottom gusset 519.

In accordance with the present invention, the portion of rear wall 516 which extends beyond front wall 514 provides tear-off region 526 for each bag. In order to facilitate removal of each bag from the tear-off region during automatic loading, each bag is provided with a central weakened segment such as a central line of perforations 528 which generally differentiates the tear-off region 526 from the remainder of the bag body. In order to further facilitate removal of each bag from its respective tear-off region 526, each bag includes first and second elongated openings 530, 532, which extend from respective opposite ends of the central line of perforations 528 toward lateral side edges 520, 522.

In the case of a non-bottom-gusseted bag (i.e., a bag without an inwardly extending bottom gusset 519), each elongated opening 530, 532 preferably extends about 25% of the width of the front wall 14 of the bag, with the central line of perforations extending between the elongated openings (i.e., the line of perforations preferably extends about 50% of the width of front wall 512). In the case of a bag which includes an inwardly extending bottom gusset, each of the elongated openings 530, 532 extends a distance about equal to the inward depth of the bottom gusset (i.e., about one-half the unfolded dimension of the gusset).

In accordance with the preferred form, each of the elongated openings 530, 532, extend substantially completely between the central line of perforations 528, and the respective one of the lateral side edges 520, 522.

Figure 10A:
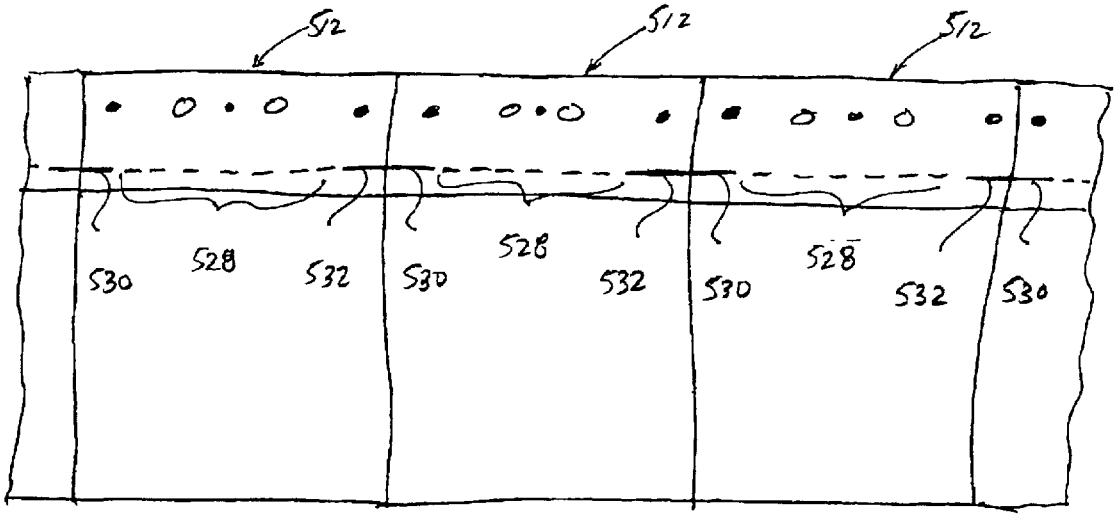
FIGS. 10A and 10B are diagrammatic views illustrating formation of bags formed in accordance with the present invention.

Bags 512 are typically formed from a web of material, in side-by-side relationship, as generally illustrated in FIG. 10A. Attendant to such formation, the bags are separated from each other at their lateral side edges by a suitable hot knife or the like. Formation in this fashion desirably acts to create a fracturable residual region at the end of each of the elongated openings 530, 532. Thus, as illustrated in FIG. 8, a fracturable residual region 534 is provided at the end of elongated opening 530, at first lateral side edge 520. Similarly, a fracturable residual region 536 is provided at the end of elongated opening 532 at the second lateral side edge 522. These residual regions desirably act to stabilize the tear-off region of each bag 512.

In accordance with the present invention, each bag includes at least one unitizing area in the tear-off region 526, with the unitizing area connecting the bags of the stack to each other. In the illustrated embodiment, three (3)-unitizing areas 538 are illustrated extending through the tear-off regions 526 of the stacked bags 512. The unitizing areas are typically formed by insertion of a suitable heated implement through the tear-off regions of the bag, thus acting to join and unitize the bag stack. The provision of such unitizing area permits the stack of bags to be mounted on a suitable support surface during automatic loading, with the tear-off regions retained by a suitable clamping element as the bags are successively loaded and removed from their respective tear-off regions. For some applications, it can be desirable for the stack of bags to be supported on a suitable wire wicket, and to this end, a pair of wicket holes 540 can be provided extending through the tear-off regions 526 of the blocked bags (wicket holes 540 are ordinarily provided to facilitate bag manufacture).

Figure 9:
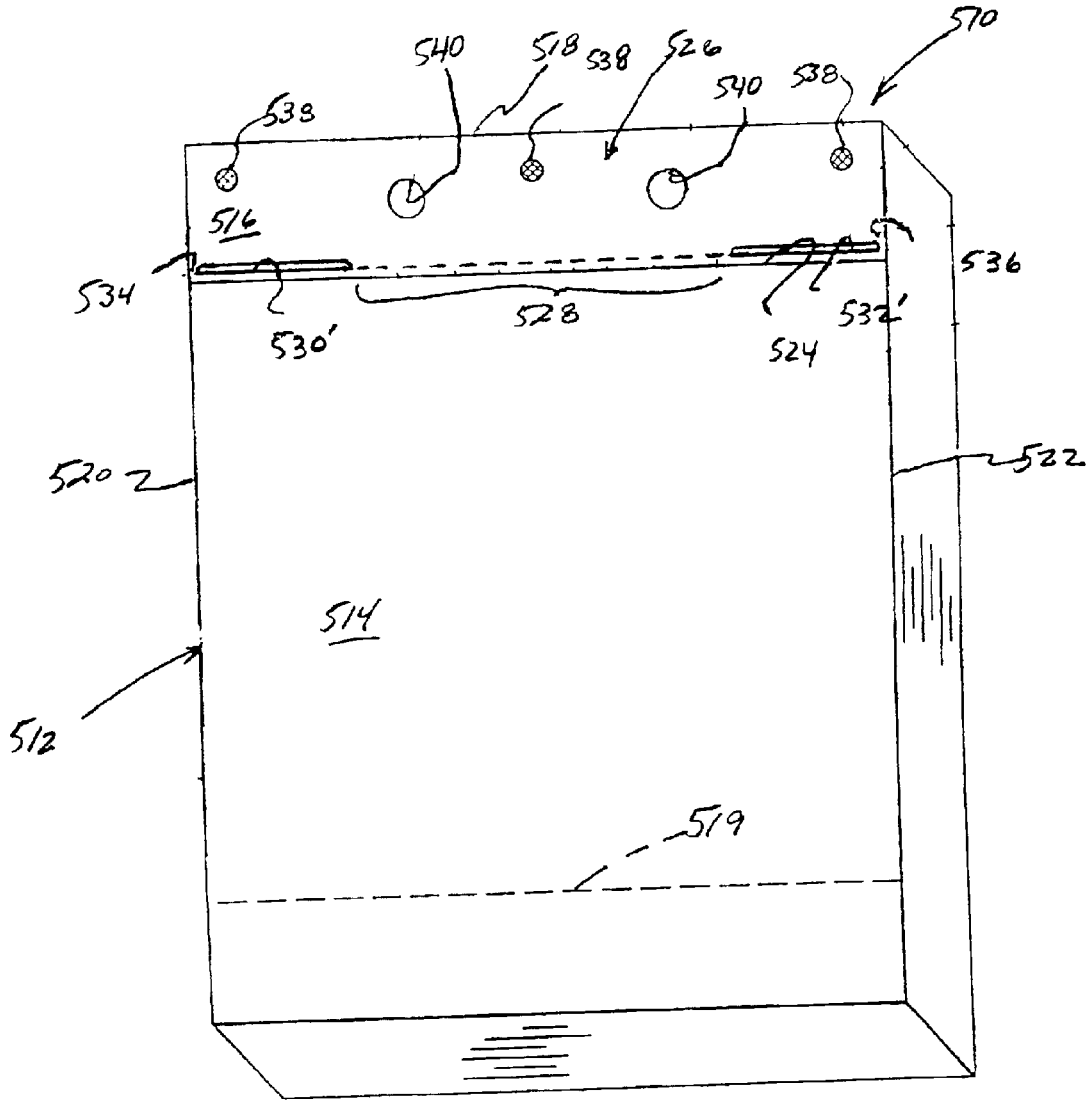
FIG. 9 is a top plan view of a stack or block of bags configured in accordance with an alternate embodiment of the present invention.
Figure 10B:
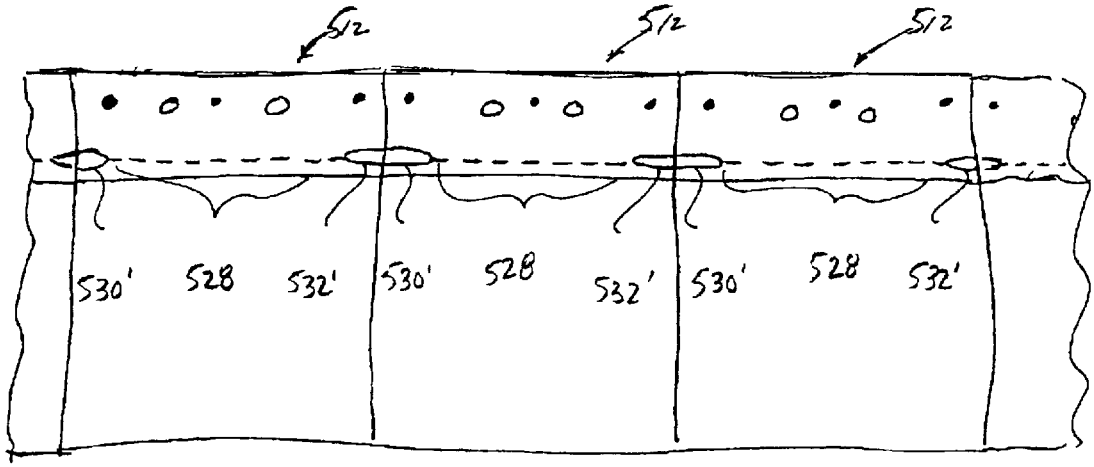

In the embodiment illustrated in FIG. 8, each elongated opening 530, 532 is disclosed as a slit formed in the rear wall 516 of each bag 512. As illustrated in FIG. 9, an alternate embodiment of the present invention includes elongated openings 530', 532' provided in the form of slots in the rear wall 516. Formation of bags configured in this fashion is diagrammatically illustrated in FIG. 10B. Depending upon the width of each slot 530', 532', residual portions 534, 536 may not be formed attendant to separation of each bag from the web.

Figure 11:
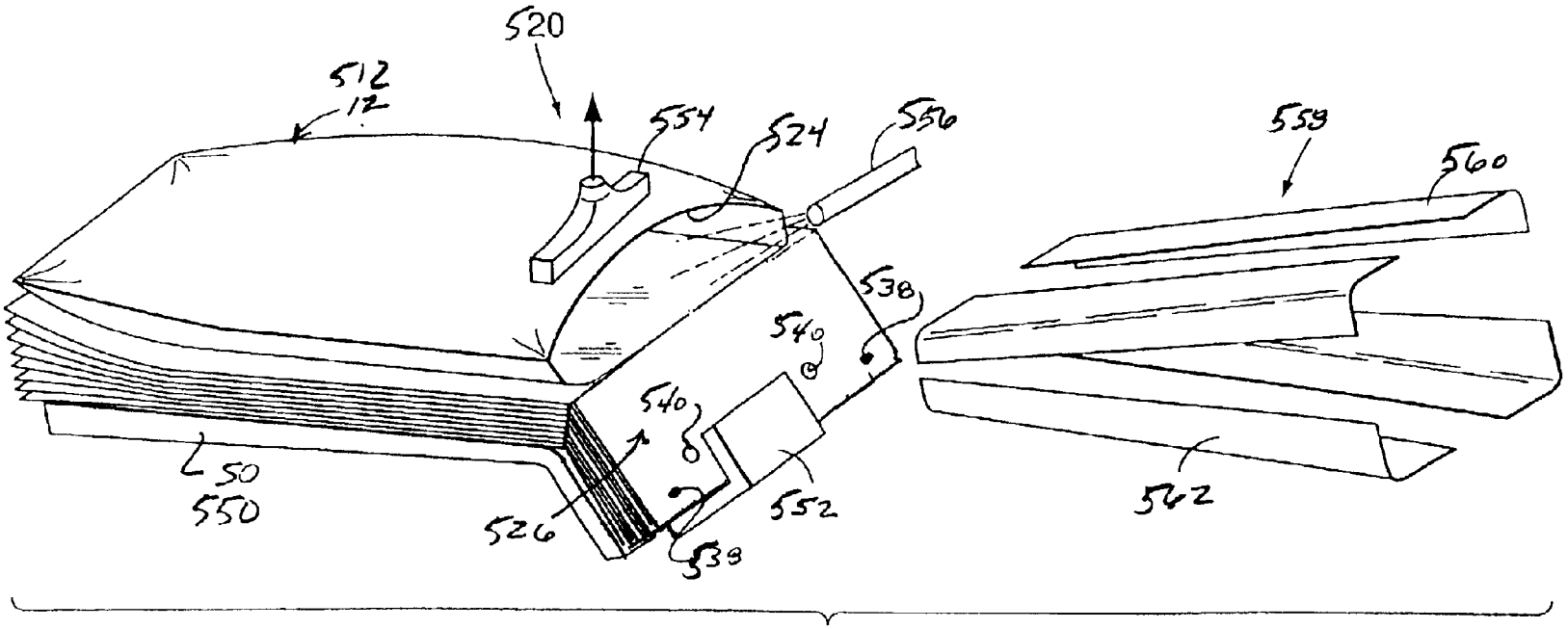
FIG. 11 is a diagrammatic view illustrating automatic loading of a block of bags formed in accordance with the present invention.

FIG. 11 diagrammatically illustrates an apparatus for effecting automatic loading of the bags 512 of the bag block 520. The bag block is mounted on a suitable support member 550, which includes a portion arranged at an acute angle for retention of the tear-off regions 526 of the bag stack by a clamp element 552. A vacuum device 554 and/or an air horn 556 can be provided for facilitating opening of the top-most bag of the bag stack.

Automatic loading is effected by relatively moving the top-most bag 512, and the product to be loaded, such as a bread loaf. In the illustrated embodiment, the automatic loading apparatus includes an insertion assembly 558, including upper and lower insertion guides 560 and 562. During automatic loading, the insertion assembly is positioned so that the insertion guides generally extend into the open mouth of the top-most bag 512 of the bag stack. The guides are then moved so as to generally open the bag, which ordinarily tears residual portions 534, 536. The product to be inserted into the bag passes through the guides and into the open bag. As the product is seated within the open bag, further relative movement of the product acts to tension the central line of perforations 528 of the top-most bag (as well as the residual portions 534, 536 if not yet torn). The now-filled bag is thus separated from its tear-off region 526 as the line of perforations 528 fracture. The filled bag moves away from the loading area for closing of the bag, while the filling process is repeated for the next top-most bag in the bag stack.

Figure 12:
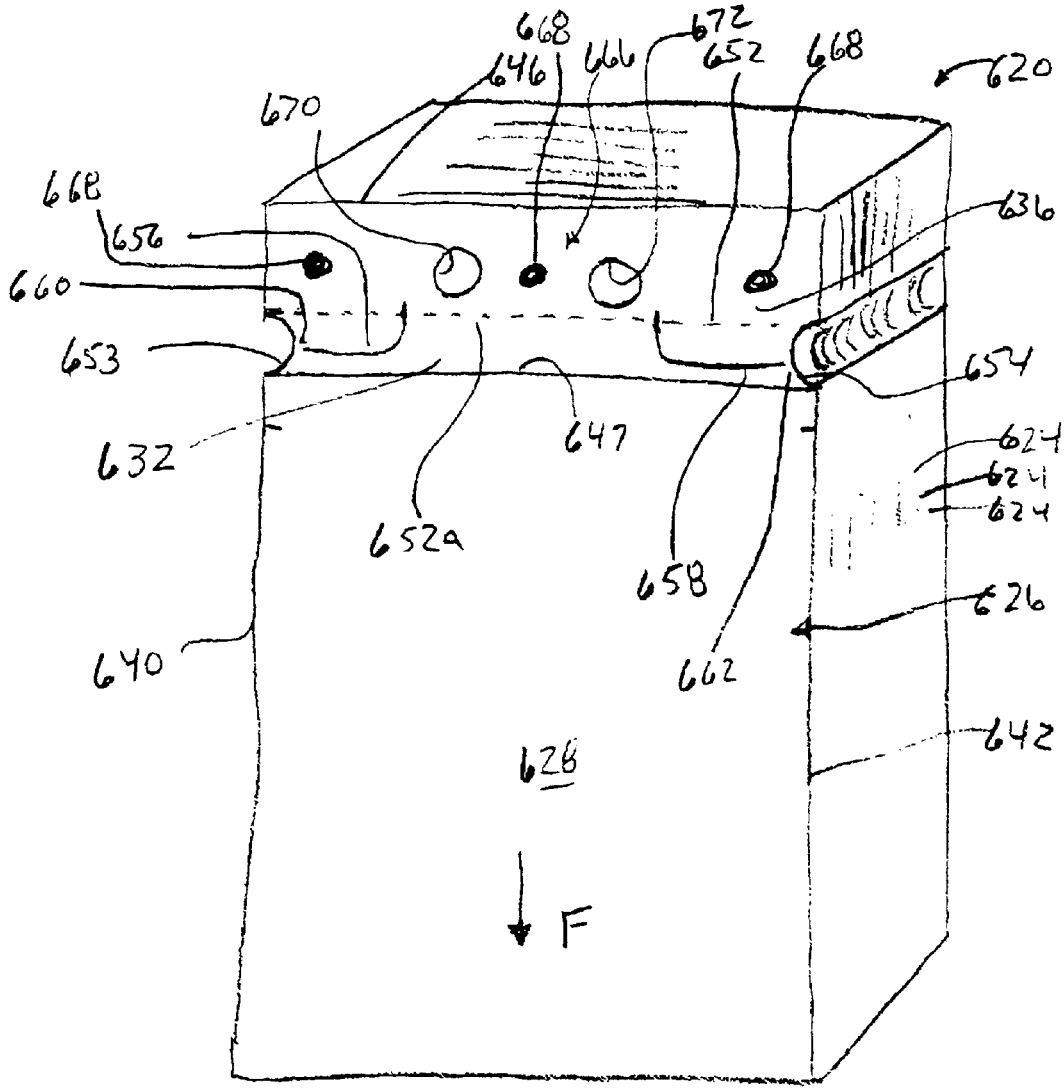
FIG. 12 is a perspective view of a first embodiment stack of bags in accordance with the present invention.

FIG. 12 illustrates a stack 620 of bags 624 according to another embodiment of the invention. Each bag 624 includes a tubular body 626 having a front wall 628 and a back wall 632 that extends upwardly of the front wall, forming a back top panel or flap 636. The bag body has first and second sealed side edges 640, 642, a top edge 646, and a bag mouth 647.

Extending perpendicularly and inwardly from the side edges 640, 642 is a weakened line such as a line of perforations 652. Each side edge includes a recess 653, 654. A first weakened segment such as a first L-shaped cut 656 extends from an end close to the recess 653 to a position close to or overlapping the line of perforations 652. A second weakened segment such as a second L-shaped cut 658 extends from an end close to the recess 654 to a position close to or overlapping the line of perforations 652. The cuts 656, 658 can be a single cut, or two or more cuts separated by one or more connecting pieces of the web. A respective bridge or web 660, 662 is formed between the recess 653, 654 and the L-shaped cuts 656, 658.

A tear off region 666 is defined by a central portion 652*a* of the line of perforations 652, the cuts 656, 658, and the recesses 653, 654 of the bag body 626. The central portion 652*a* is located between the cuts 656, 658. Within the tear off region 666, one or more unitizing regions 668 are formed through the stack 620, substantially perpendicularly to the plane of the back wall 632. The unitizing regions 668 are formed by penetrating the stack 620 with a hot pin, which forms a hole through the stack and melt-fuses together the bags 624 within the regions 668. The holes formed within the regions 668 can be made large enough to subsequently receive rods for guiding or supporting the stack.

Wicketing holes 670, 672, and/or pinholes (not shown), can be located within the panel 666 which are utilized as described in U.S. Pat. No. 4,699,607. The wicketing holes 670, 672 and/or the pinholes act in conjunction with posts and/or sharpened pins to align bags during stack formation. Subsequently, the wicketing holes 670, 672 can receive posts or rods to guide and/or support the stack and allow individual bags to be torn from the stack.

It is an advantageous aspect of the invention that the portion 652*a* of the line of perforation 652 is perpendicular to the tear off or pull direction F when a user or automated equipment is separating a bag 624 from the stack 620. In this way, maximum tensile stress is exerted on residual web material along the portion 652*a*. The shear regions are minimized due to the cuts 656, 658 extending upwardly to the portion 652*a*.

Figure 13:
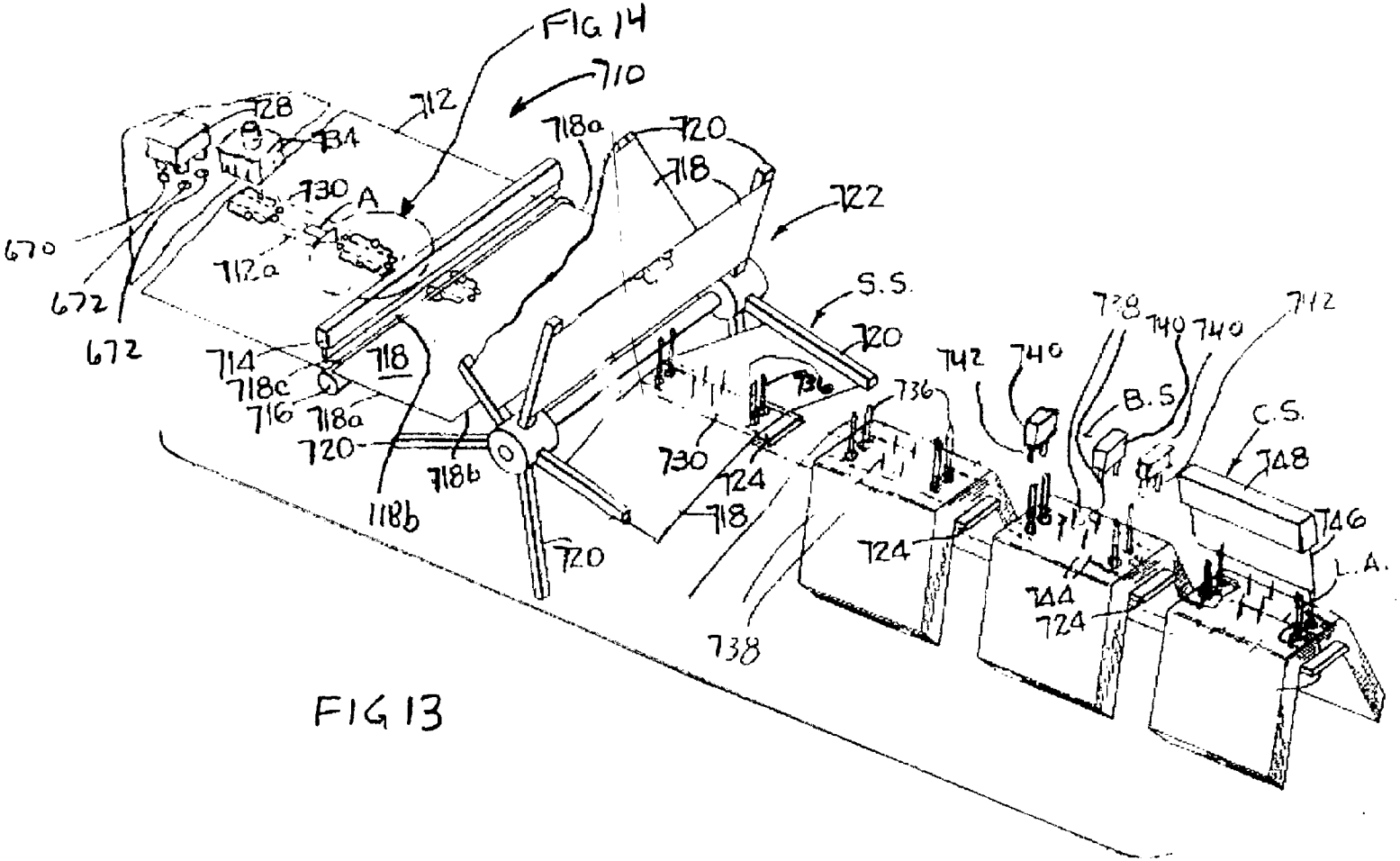
FIG. 13 is a schematic diagram illustrating a method of forming bag blocks according to the invention.

Exemplary apparatus to form bags according to the present invention is shown in FIG. 13, generally designated by the numeral 710. The apparatus as shown would be used to manufacture the bag block shown in FIG. 12, for example. A web strip 712 is intermittently advanced by a conventional bag machine (not shown) which may be substantially similar to the machine disclosed in the aforementioned U.S. Pat. No. 4,451,249. Feed rolls or draw rolls (not shown) advance the web strip 712 a predetermined amount between a seal bar 714 and a platen roll 716 forming a sheet 718 which is engaged at its longitudinal edges 718*a* by a pair of transversely aligned arms 720 of a conventional transfer mechanism 722. As a sheet is formed, it is promptly engages by a pair of the radially extending arms 720 and transferred in a generally arcuate path to one of a plurality of stacking plates 724 located at a stacking station S.S. As disclosed in the above-referenced U.S. Pat. No. 4,451,249, the stacking plates 724 are carried by a conveyor chain mounted on a frame defining an orbit having an upper reach and a lower reach and driven by an indexing mechanism. The indexing mechanism locates successive blades 724 at the stacking station S.S. for a selected period of time determined to accumulate a predetermined number of sheet 718 on the respective stacking plates 724.

An area of the web strip 712 upstream from the seal bar 714 is provided, in its central medial zone, identified by dotted lines 712*a*, with four wicket holes 670, 672 formed by a reciprocating punching device 728 during the period of time when advance of the web strip, in the direction of the arrow A, is arrested.

As the web is advanced another increment, the line of perforations 652 the recesses 653, 654 and the cuts 656, 658 for four bags according to the embodiment of FIG. 12 are formed by a punch 732 having an interrupted cutting edge. Four bags 624 are formed connected side-to-side and end-to-end with a common corner, as shown more clearly in FIG. 14. The punch 732 is rigidly connected to a reciprocating rod 734 which is operated to form the line of perforations 652 and cuts 656, 658 during the period of web repose.

Alternatively, the line of perforations 652 could be formed along the web strip by a continuous punching device. Also, it is also possible to form the wicket holes 670, 672, the recesses 653, 654, the cuts 656, 658, and the line of perforations 652 by the action of a single punch element.

Figure 14:
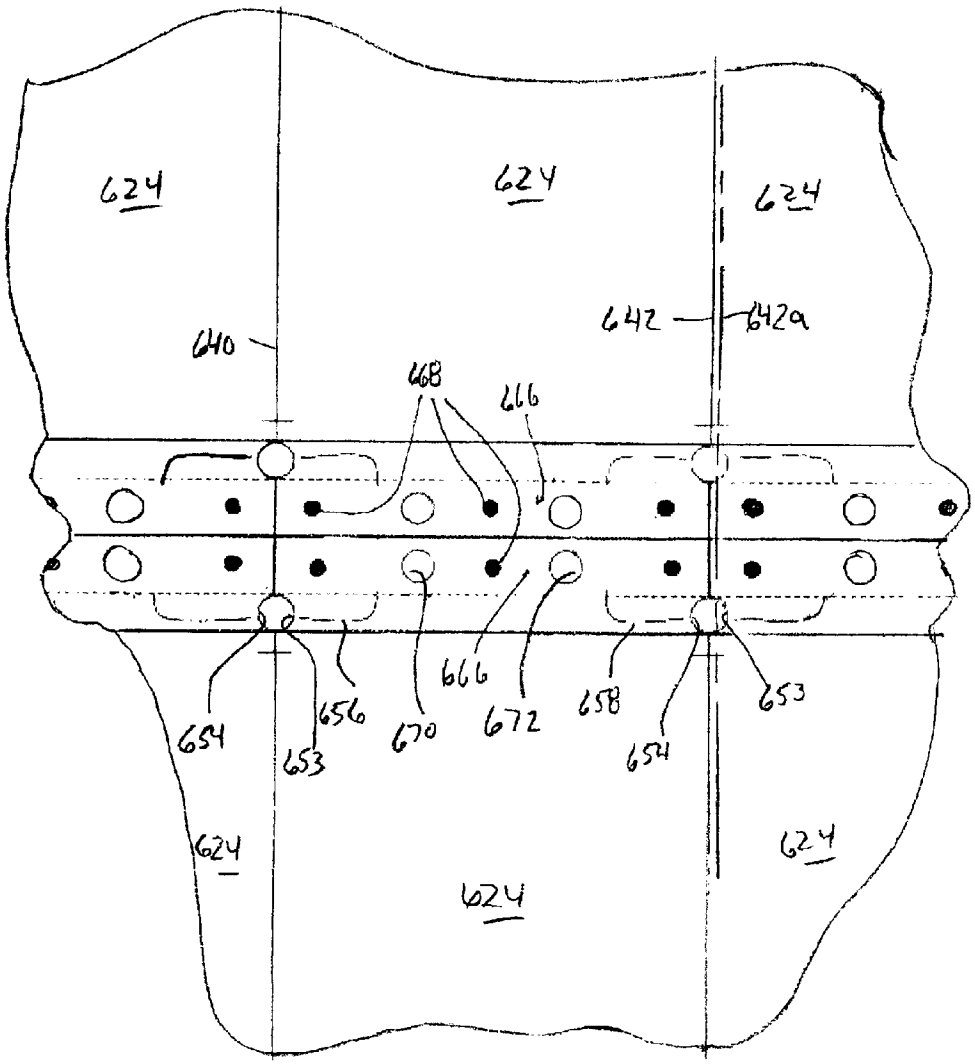
FIG. 14 is an enlarged fragmentary plan view taken from FIG. 13.

Each web strip 718, defined by the cooperative action of the seal bar 714 and the platen roll 716, accordingly includes, in the medial zone along each of the leading edge 718*b* and the trailing edge 718*c*, two wicket holes 670, 672 located within respective tear off regions 666 as illustrated more clearly in enlarged FIG. 14. The leading edge 718*b* and the trailing edge 718*c* correspond to the side edges 640, 642 of the bags illustrated in FIG. 12.

Each stacking plate is provided with upwardly extending posts 736 having the upper portion thereof slightly tapered and positioned to receive a succession of sheets impaled thereon as a pair of arms 720 holding a sheet approaches and sweeps by the stacking plate 724 located at the stacking station S.S. In addition to the posts 736 which project through the pre-punched holes, each plate 724 can be provided with upwardly extending sharpened pins 738 located on either side of an imaginary longitudinal axis L.A. The sharpened pins 738 puncture and penetrate the sheet as it is deposited on the stacking plate 724 and served to firmly retain successive sheets so that a registered stack (meaning that the marginal edges of successive sheets overly each other) is produced.

On depositing a selected number of sheets on a stacking plate 724, the conveyor mounting the plates 724 is indexed, transporting the completed stack to a blocking station B.S. where the sheets are penetrated by heated blades to establish unitizing regions within the tear off regions 666. The apparatus to effect blocking include one or two holders or bars 740 associated with a mechanism such as a pneumatic or hydraulic power cylinder, to forcibly displace the holders 740 toward and away from the stack of sheets. The holders mount blade-like elements 742 that are electrically heated to a temperature to effect fusion of the sheets brought in contact with the surface of the blades 742. On forcibly engaging and penetrating the sheets, the blades or elements 742 produce the unitizing regions described previously in FIG. 12. These unitizing regions can be a variety of different shapes and styles as previously described. According to the method of FIG. 12, at the blocking station all of the sheets are joined along the unitizing regions.

On indexing the blocked sheets to a downstream station, preferably an adjacent downstream station, cutting of the sheets along the longitudinal axis LA occurs. The cutting station C.S. comprise a knife 746 mounted in a holder 748 connected to one or more conventional linear actuators operating to automatically, or at the demand of the operator, to move forward and away from the stacking plate 724 in order to divide the sheets into individual bag blocks as shown in FIG. 12.

FIG. 14 illustrates four bags 624 joined at a central corner to be separated later in the process, which advantageously lays out the necessary wicket holes and perforations for an efficient operation. The recesses 653, 654 are formed back to back as circles having about a 12 mm diameter. When side-by-side bags are separated, the recesses are semicircular. Other shapes are encompassed by the invention, as a semicircular shape is not a necessity. Because the recesses 653, 654 are punched with the same punch as the adjacent L-shaped cut, the bridge 660, 662 is always formed with a consistent length, and does not depend on the accuracy of the location of the bag side seals 640, 642. The bag side seals can be formed at varied positions with respect to the location of the back to back recesses 653, 654 along the length of the recesses without affecting the bridge lengths. For example an offset side seam 642*a* is shown which would not affect the lengths of the bridges 660, 662. The bridges would be broken during bag tube formation with the same consistent force. Thus, regarding this aspect, an increased bag-forming tolerance is achieved. FIG. 16 illustrates an alternate embodiment wherein the recesses are in the form of slits 685, 686, the slits preferably being continuous. The slits 685, 686 are punched with the respective L-shaped cuts and function in like manner as the recesses 653, 654. The slits 685, 686 together also have a preferred length of 12 mm.

Although FIG. 13 and FIG. 14 illustrate a machine which forms two blocks of bags simultaneously before being separated into two blocks by the cutter 746, the bags could alternatively be formed by stacking single bag segments. In such a case, a machine similar to that shown in FIG. 13, but missing one half of the web material on one side of the longitudinal axis LA, is used. No cutter 746 is thereby required, and a single draped stack of bags, hung from posts penetrating corner wicket holes and/or sharpened pins, is produced.

Figure 15A:
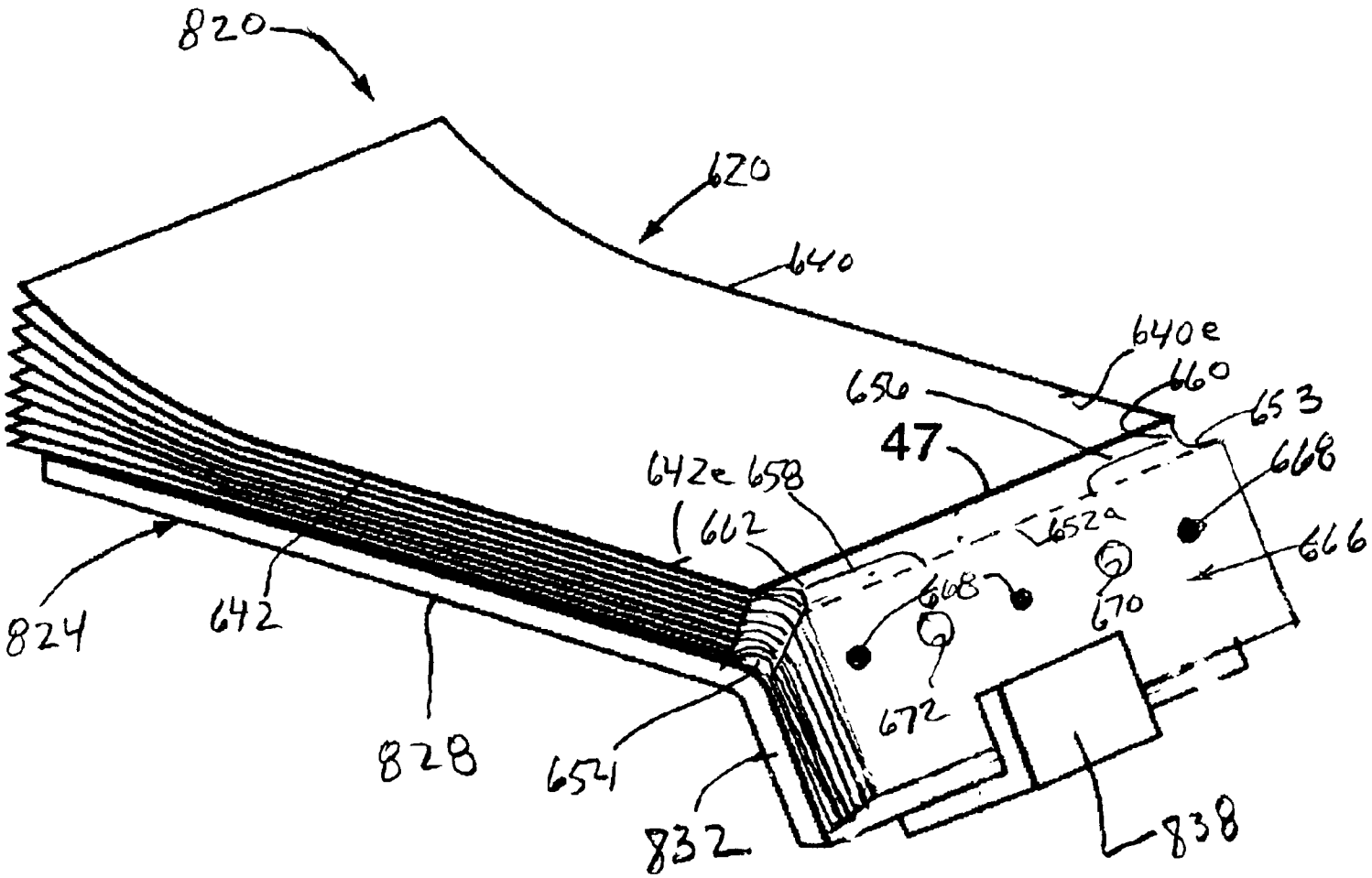
FIG. 15A is a perspective view of a bag filling apparatus of the invention in a first stage of operation.

FIG. 15A illustrates the block 620 in a filling station 820 supported on a support table 824. The support table 824 includes a substantially horizontal support plate 828 and an oblique, lip-supporting plate 832. The central lip region 714 is supported on the plate 832 and clamped thereon by a clamp member 838. Alternatively, or additionally, wicket pins supported by a bracket can penetrate through a backside of the plate 832 through the wicket holes 670, 672 to hold the tear off region 666 on the plate 832.

Figure 15B:
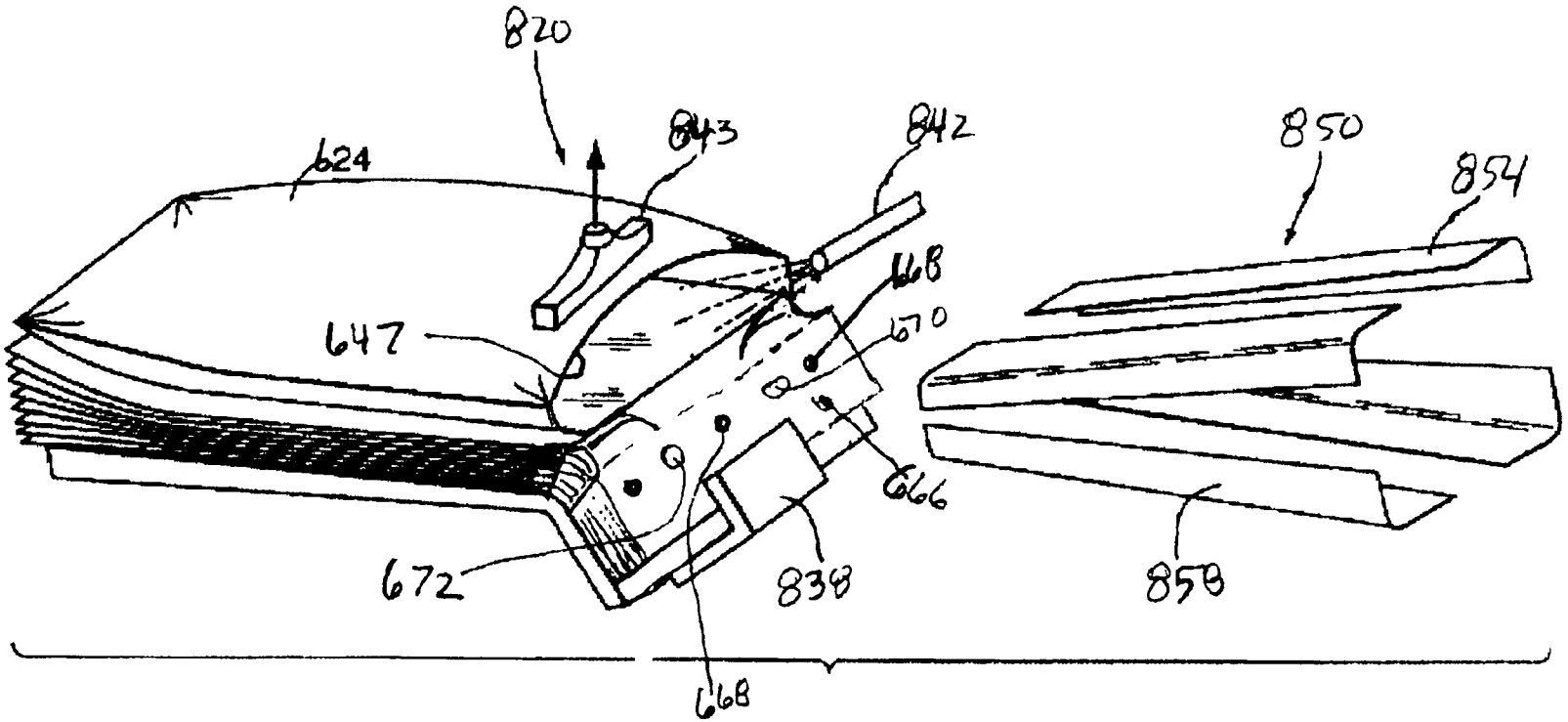
FIG. 15B is a perspective view of the bag filling apparatus of FIG. 15A in a second stage of operation.

FIG. 15B illustrates an air delivery device 842 blowing an air stream onto the top bag 624 particularly into the mouth 647 of the top bag 624. The air stream tends to open the bag from a flat condition to a rectangular or pillow shaped configuration. Alternately, or additionally, a suction device or suction cup 843 can be used to open the mouth 647. The suction device 843 can be configured to engage the bag wall at the mouth and then to move upwardly to open the mouth. An opening device 850 which includes an upper opening mechanism or spoons 854 and a lower opening mechanism or spoons 858 is configured to be inserted into the open mouth 647 of the top bag 624.

Figure 15C:
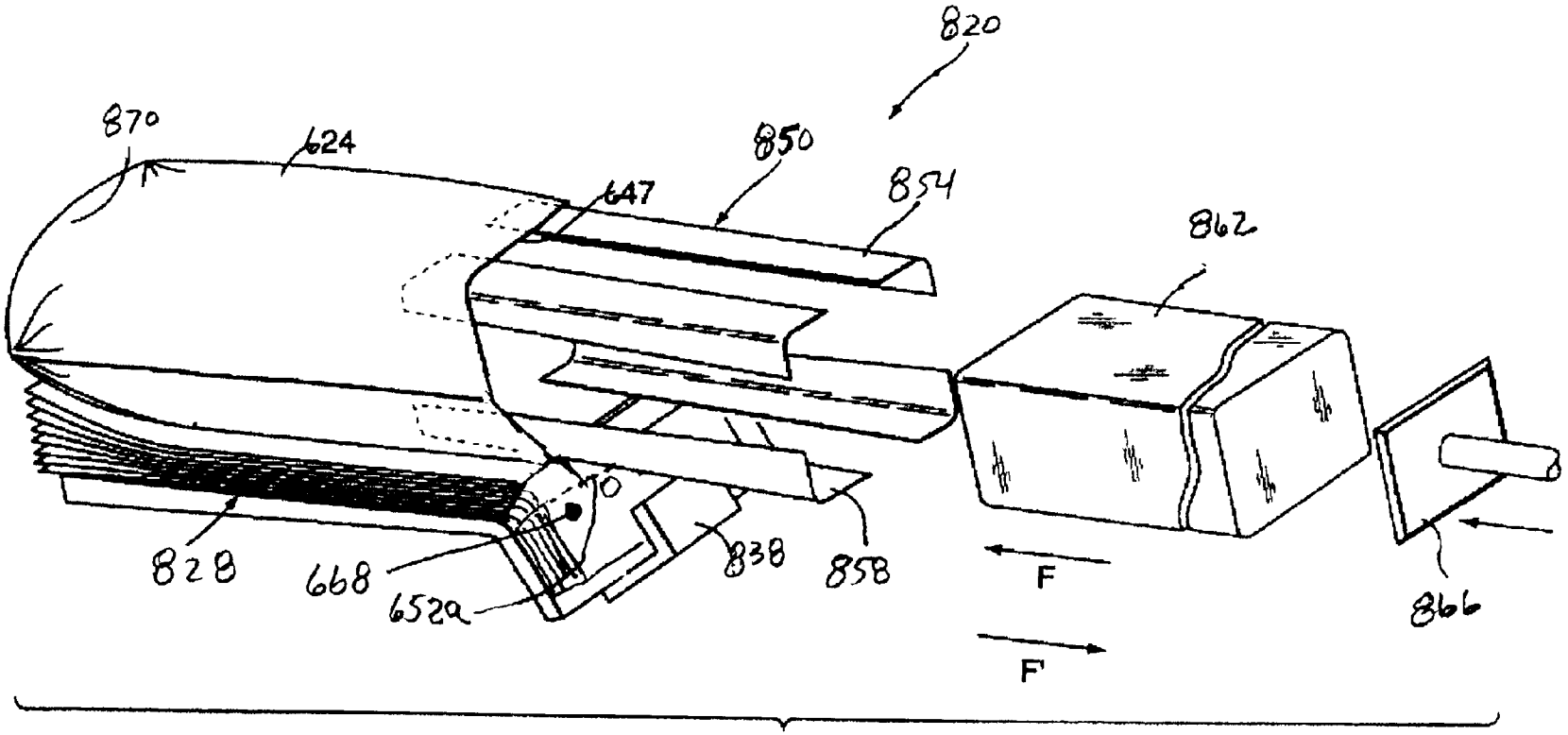
FIG. 15C is perspective view of the bag filling apparatus of FIG. 15A in a third stage of operation.

FIG. 15C shows the opening device 850 inserted into the bag mouth 647 and then having the spoons 854, 858 pivoted to expand the device 850 to hold the bag 624 in the open configuration. A product 862 is inserted into the bag 624 through the opening device 850. The product 862 is inserted via a pusher 866 which pushes the product 862 through the bag and against an end wall 870 thereof with a force sufficient to tear the top bag 624 along the perforation line 652*a* to separate the top bag 624 from the block 620. This force is along the direction F. A side seal discontinuity or seal saver 640*e*, 642*e* is located along each respective side seal 640, 642, 640*c* to stop the propagation of a rip down the side seal during bag opening.

According to another known filling method, the spoons open the bag and then draw the bag in a reverse direction to the direction the spoons entered the bag, i.e., in a forward direction, along the line F, to separate the bag from the block and at the same time to capture a stationary product within the moving bag. The apparatus of FIGS. 15A–15C are equally applicable to this method, with the exception of the pusher.

From the foregoing, it will be observed that numerous variations and modifications may be effected without departing from the spirit and scope of the invention. It is to be understood that no limitation with respect to the specific apparatus illustrated herein is intended or should be inferred.

What is claimed is:

1. A method of making bags comprising the steps of:

providing a web of film material, moving the web in a longitudinal direction, folding the web material laterally to form bag front walls and back walls, the back walls extending past said front walls, forming lips;

forming spaced-apart openings into said lips, and a pair of elongated weakened segments in each said lip between adjacent ones of said openings wherein adjacent openings are located spaced apart by a width of a bag-to-be-formed and said segments extends longitudinally of the web material, each said opening and an adjacent one of said weakened segments being separated by a distance that defines a frangible bridge that is broken to define a consistent opening force to open each bag-to-be-formed from a flat state to an open state;

forming a longitudinally extending central weakened segment in each of said lips which extends between the pair of elongated weakened segments of each said lip, wherein said central weakened segment is less easily torn than said pair of elongated weakened segments; and sealing the web laterally through each said opening to define lateral edges of each bag, said lateral edges located transverse to said longitudinal direction through said openings.

2. The method of making bags according to claim 1, wherein each said opening and adjacent ones of said elongated weakened segments are punched simultaneously.

3. The method of making bags according to claim 1, wherein each of said openings is circular.

4. The method of making bags according to claim 3, wherein each of said openings is formed from a circular punch having about a 12 mm diameter.

5. The method of making bags according to claim 1, wherein each of said openings comprises a slit.

6. The method of making bags according to claim 1, wherein each of said elongated weakened segments is provided in the form of a slit.

7. The method of making bags according to claim 1, wherein each of said elongated weakened segments is provided in the form of a slot.

8. The method of making bags in accordance with claim 1, wherein said central weakened segment formed in each said lip is transversely offset from portions of said pair of elongated weakened segments formed in each said lip.

* * * * *